US005856740A

United States Patent [19]

Rau et al.

[11] Patent Number: 5,856,740

[45] Date of Patent: Jan. 5, 1999

[54] SHUNT VOLTAGE REGULATOR WITH A VARIABLE LOAD UNIT

[75] Inventors: C. Peter Rau, Apalachin; Glenn E. Wilson, Endicott, both of N.Y.

[73] Assignee: Emerson Electric Co., St. Louis, Mo.

[21] Appl. No.: 853,218

[22] Filed: May 9, 1997

[51] Int. Cl.[6] ..... G05F 1/613

[52] U.S. Cl. ..... 323/233; 323/223; 323/225; 323/272; 323/299

[58] Field of Search ..... 323/220, 223, 323/225, 233, 267, 272, 283, 299

[56] References Cited

U.S. PATENT DOCUMENTS

| | | | |
|---|---|---|---|
| 3,670,230 | 6/1972 | Rooney et al. | 323/223 |
| 3,793,535 | 2/1974 | Chowdhuri | 307/202 |
| 4,023,071 | 5/1977 | Fussell | 361/56 |
| 4,068,279 | 1/1978 | Byrnes | 361/56 |
| 4,095,163 | 6/1978 | Montague | 323/8 |
| 4,152,743 | 5/1979 | Comstock | 361/56 |
| 4,156,838 | 5/1979 | Montague | 323/8 |
| 4,259,705 | 3/1981 | Stifter | 361/56 |
| 4,434,396 | 2/1984 | Mongague | 323/230 |
| 4,463,406 | 7/1984 | Sirel | 361/56 |
| 4,467,268 | 8/1984 | Chambers et al. | 323/272 |
| 4,563,720 | 1/1986 | Clark | 361/56 |
| 4,584,622 | 4/1986 | Crosby et al. | 361/56 |
| 4,814,966 | 3/1989 | Exstrand | 323/233 |
| 4,870,528 | 9/1989 | Harford | 361/56 |
| 4,870,534 | 9/1989 | Harford | 361/58 |
| 5,349,284 | 9/1994 | Whittle | 323/285 |
| 5,572,112 | 11/1996 | Saeki et al. | 323/282 |
| 5,644,214 | 7/1997 | Lee | 323/222 |
| 5,747,972 | 5/1998 | Baretich et al. | 323/283 |

OTHER PUBLICATIONS

Sep. 13, 1995 letter from John C. Gennaro to Mr. Allen Amos (with advertisements attached) regarding Brick Wall® Series Mode Surge and Power Filters.

Sep. 22, 1994, Paper Presented at Power Quality '94 Conference, Dallas Texas "Series Mode Suppression or Shunt Mode448 What's the Difference?" by Jack Hartford.

*Primary Examiner*—Jeffrey L. Sterrett
*Attorney, Agent, or Firm*—Arnold, White & Durkee

[57] ABSTRACT

A voltage regulator for regulating a power source that supplies an input signal includes input terminals connected across the power supply, a voltage sensor, a reference generator, a variable load unit, and a control unit. The voltage sensor is connected across the input terminals and receives the input signal and generates a scaled input signal from the input signal that is a fraction of the input signal in magnitude. The reference generator receives the scaled input signal from the voltage sensor and generates a reference signal. The variable load unit is connected across the input terminals. The control unit receives and compares the scaled input signal and the reference signal and instructs the variable load unit to dissipate a first portion of the input signal if the scaled input signal exceeds the reference signal.

48 Claims, 26 Drawing Sheets

SHUNT VOLTAGE REGULATOR WITH A VARIABLE LOAD UNIT

FIELD OF THE INVENTION

The present invention relates in general to voltage regulators designed to protect electrical loads from spikes and transients present on a power line, and more specifically to a shunt voltage regulator adapted to track normal power line conditions and determine a minimum clamping voltage, thus providing the greatest degree of protection to the regulated loads.

BACKGROUND OF THE INVENTION

Undesirable power line transients have the potential to damage sensitive electrical equipment present on the line. Transients can be caused by external sources of energy such as a lightning strike, energy from an inductive load fed back to the line, or from power line switching. In order to protect the loads on the power line, this additional energy must be either dissipated or stored and later returned to the line. Due to cost and technological complications associated with storing the energy and returning the energy to the line, the dissipation option is most often selected.

Prior art voltage regulators and transient protection devices typically rely on either a series inductor and a fixed clamping voltage device to provide transient protection to loads on the power line. Series inductors of the type required for transient protection tend to be quite large, therefore resulting in voltage regulators with undesireably high weights and sizes.

Fixed voltage protection circuits must have a clamping voltage greater than the largest peak voltage being protected against plus some component tolerances. Fixed clamping voltage circuits use passive devices such as metal oxide varistors, silicon avalanche diodes, or other devices having fixed breakdown voltages to provide this fixed voltage protection.

In order to afford the most effective protection to the loads being protected it is desirable to set the clamping voltage at a level above, but very close to, the normal voltage of the line. In a voltage regulator with a fixed clamping voltage, the clamping voltage must be significantly higher than the line voltage due to changing line voltage and other technological problems, thus allowing some transients to be unregulated. These unregulated transients may damage sensitive electronic equipment.

SUMMARY OF THE INVENTION

The present invention in a broad aspect addresses the problems and shortcomings mentioned above. More specifically, an aspect of the invention is seen in a voltage regulator for regulating a power source that supplies an input signal. The voltage regulator includes input terminals connected across the power supply, a voltage sensor, a reference generator, a variable load unit, and a control unit. The voltage sensor is connected across the input terminals and receives the input signal and generates a scaled input signal from the input signal that is a fraction of the input signal in magnitude. The reference generator receives the scaled input signal from the voltage sensor and generates a reference signal. The variable load unit is connected across the input terminals. The control unit receives and compares the scaled input signal and the reference signal and instructs the variable load unit to dissipate a first portion of the input signal if the scaled input signal exceeds the reference signal.

Another aspect of the invention is seen in a method for regulating an input voltage signal. The method includes the acts of sensing the voltage of the input signal to determine an input voltage; determining a reference voltage dependent on the input voltage; comparing the input voltage and the reference voltage; and dissipating a portion of the energy in the input signal when the input voltage exceeds the reference voltage.

A further aspect of the invention is seen in a voltage regulator connected to a power source that supplies an input signal. The voltage regulator includes means for receiving the input signal and generating a scaled input signal from the input signal that is a fraction of the input signal in magnitude; means for receiving the scaled input signal and generating a reference signal; means for dissipating energy in the input signal; and means for receiving and comparing the scaled input signal and the reference signal and instructing the dissipating means to dissipate a first portion of the input signal if the scaled input signal exceeds the reference signal.

BRIEF DESCRIPTION OF THE DRAWINGS

The foregoing and other advantages of the invention will become apparent upon reading the following detailed description and upon reference to the drawings in which.

DESCRIPTION OF ILLUSTRATIVE EMBODIMENTS

Figure 1:
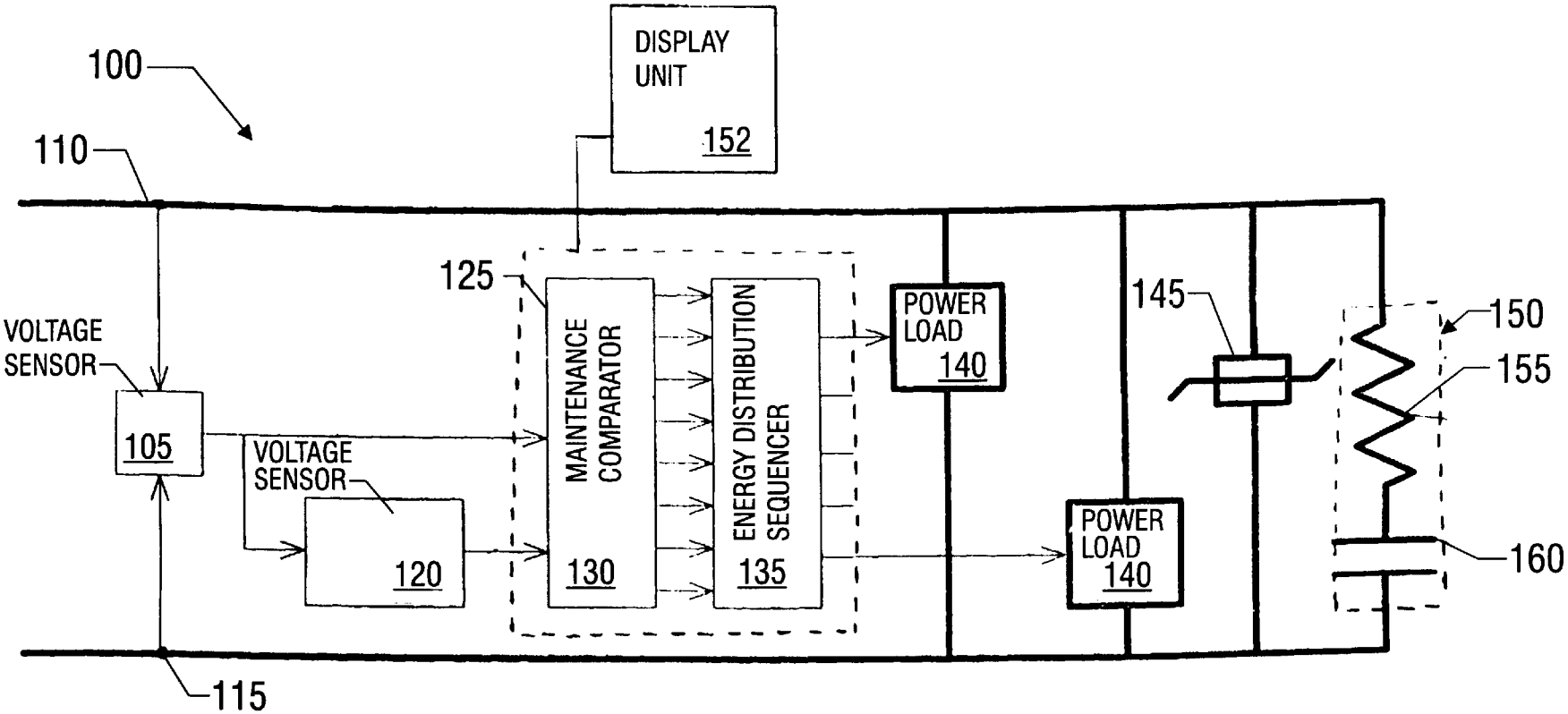
FIG. 1 illustrates a block diagram of a shunt voltage regulator according to the present invention.

Referring to FIG. 1, a block diagram of a voltage regulator 100 of the invention is shown. The high current paths and components are shown in bold lines and the control circuits are shown with thinner lines. The voltage regulator 100 operates in a shunt mode, connected across the line being protected. Voltage sensor 105 senses the voltage of the input signal on the line at the input terminals 110, 115 and provides a scaled input signal 118 representative of the input voltage. The input voltage is scaled to a lower voltage in order to be used by the control electronics which operate at a voltage that is generally lower than the line voltage seen on a typical power line. Depending on the rating of the control electronics relative to the input voltage, the input voltage may not require scaling. In this alternative embodiment, the fraction of the input voltage to the scaled input signal 118 may be unity (e.g. 1/1).

Typically, the voltage signal seen on a power line is comprised of a normal component and transient components, such as surges or spikes. These surges or spikes may be the result of a lightning strike or energy from an inductive motor being fed back to the line. The normal component of the input voltage may gradually rise or fall over time depending on the general conditions seen by the power system.

A reference generator 120 receives the scaled input signal 118 from the voltage sensor 105. The reference generator 120 monitors the scaled input signal 118 over time and determines a clamping voltage that is typically slightly higher than the normal component. The clamping voltage is slowly adjusted according to variations in the input voltage, such as by an integrating control loop. The reference generator 120 outputs a clamping reference signal 122 corresponding to the clamping voltage. The function of the reference generator 120 is described in more detail below in reference to FIGS. 6 through 10.

Figure 6:
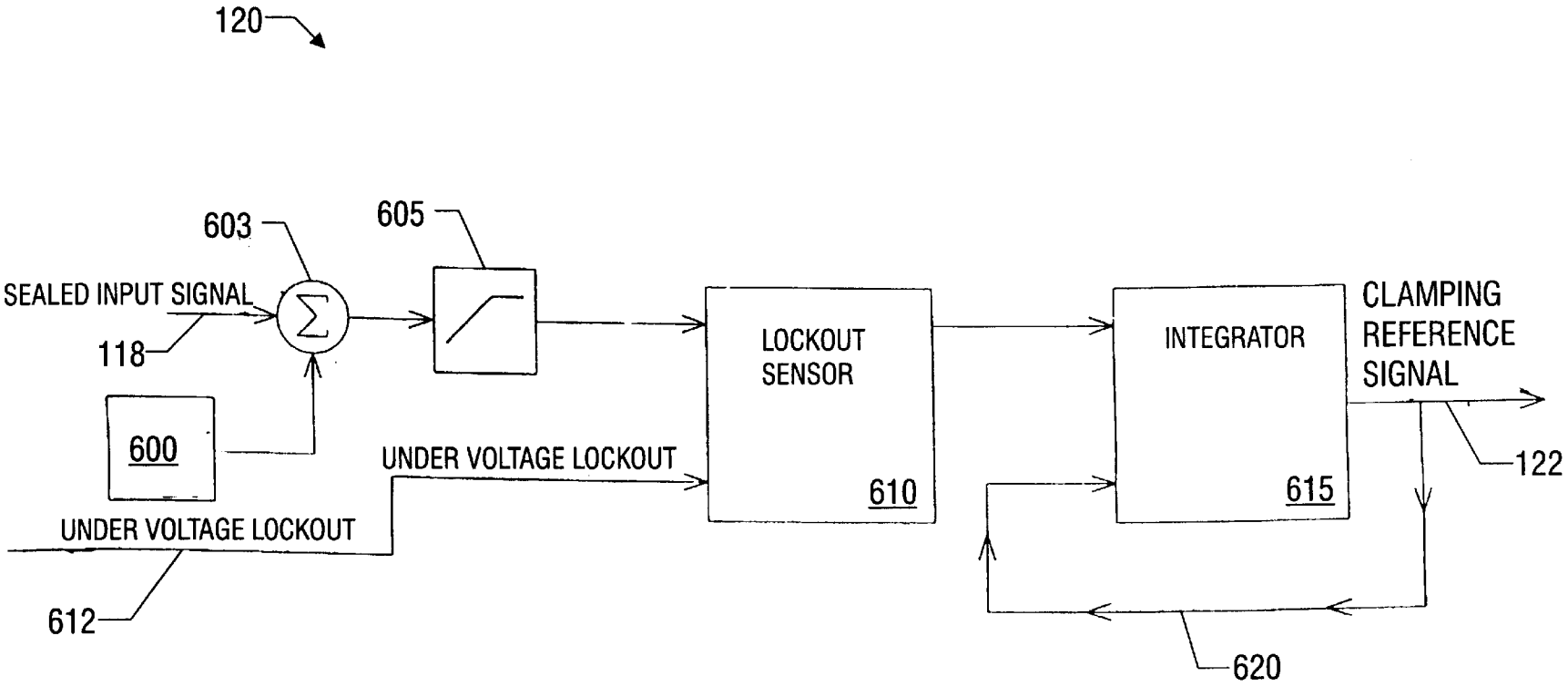
FIG. 6 illustrates a block diagram of the reference generator of FIG. 1 using a fixed voltage offset.

Referring to FIG. 6, a load control unit 125 receives the scaled input signal 118 and the clamping reference signal 122 and compares the two values in a magnitude comparator 130. If the scaled input signal 118 rises above the clamping reference signal 122, the magnitude comparator 130 signals an energy distribution sequencer 135 to activate a series of power loads represented generally by block 140, one at a time, until the necessary current has been shunted to force the scaled input signal 118, which represents the input voltage at the terminals 110, 115, to the clamping voltage set by the reference generator 120. Although a plurality of power loads 140 are shown in the illustrated embodiment, it is contemplated that a different variable loading device may be substituted for the plurality of power loads. The energy distribution sequencer is described in greater detail below in reference to FIGS. 11 and 12. An example power load 140 consisting of a printed circuit board resistor is described in greater detail below in reference to FIGS. 13*a* and 13*b*.

The portion of the voltage regulator 100 that tracks the input signal and activates power loads 140 to dissipate excess energy is referred to as the active portion of the voltage regulator.

If all power loads 140 have been activated, and the input voltage still has not been limited, the input voltage will increase until an overflow device 145 starts conducting to further dissipate excess power in the input signal. The overflow device 145 may comprise one or more paralleled metal oxide varistors (MOVs), silicon avalanche diodes, or other shunting devices having a specified breakdown voltage. Hereinafter, the overflow device 145 will be referred to as MOVs.

A snubber 150 is also connected across the terminals 110, 115 as shown in FIG. 1. The snubber 150 functions to dissipate a portion of the energy resulting from high rate of change perturbations in the input signal, and secondly to decrease the voltage variations while changing the quantity of power loads 140 engaged. In the illustrated embodiment, the snubber 150 includes a resistor 155 in series with a capacitor 160. Alternatively, the capacitor 160 may be used without a resistor 155. The resistor 155 is used to keep the capacitor 160 from ringing with external line inductance or added inductance. The functions of the snubber 150 with respect to decreasing the voltage variations while changing the quantity of power loads 140 engaged is described below in reference to FIG. 14.

Figure 23A:
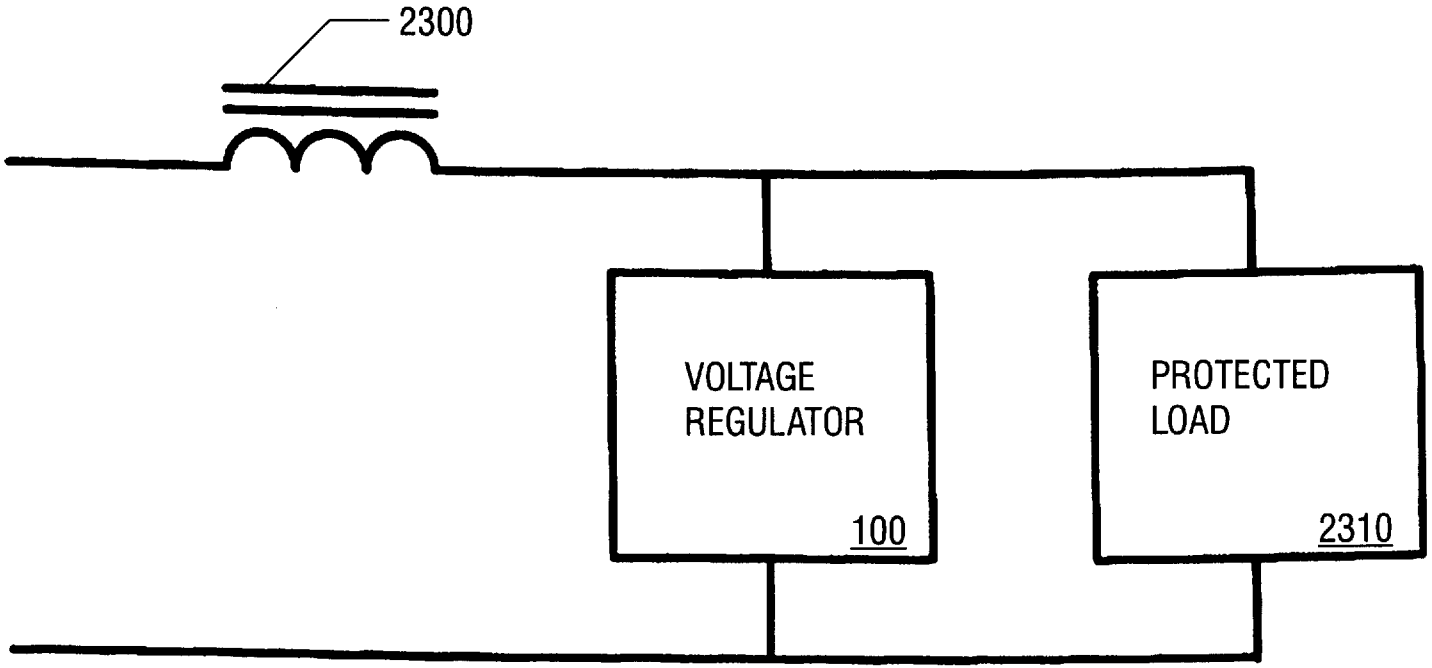
FIG. 23*a* illustrates the voltage regulator of FIG. 1 including a series inductance.
Figure 23B:
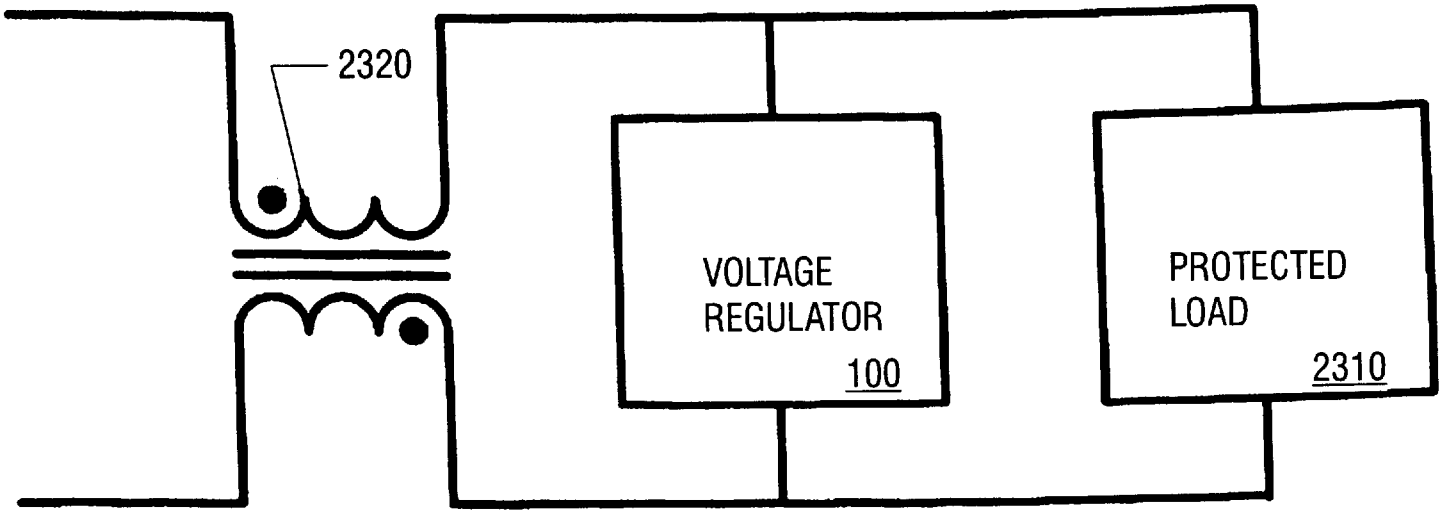
FIG. 23*b* illustrates the voltage regulator of FIG. 1 including a differential mode series inductance.

The MOVs 145 and snubber 150 provide passive protection, and are therefore referred to as the passive portion of the voltage regulator 100. The passive portion may also include a series inductor to further regulate the input signal, but unlike other prior art voltage regulators, this series inductance is not required. FIGS. 23*a* and 23*b* illustrate the voltage regulator 100 used with a series inductance. In FIG. 23*a,* an inductor 2300 is connected in series between the power source and the voltage regulator 100. The protected load 2310 is connected in parallel with the voltage regulator 100. The inductor 2300 may be placed in series with either the positive or negative feed from the power source. As seen in FIG. 23*b,* a differential mode inductor 2320 is connected in series between he power source and the voltage regulator 100. The load 2310 is connected in parallel with the voltage regulator 100.

A display unit 152 such as resetable digital readout may be connected to the load control unit 125 to indicate the number of activations of the voltage regulator 100 that have occurred since the last reset.

Figure 2:
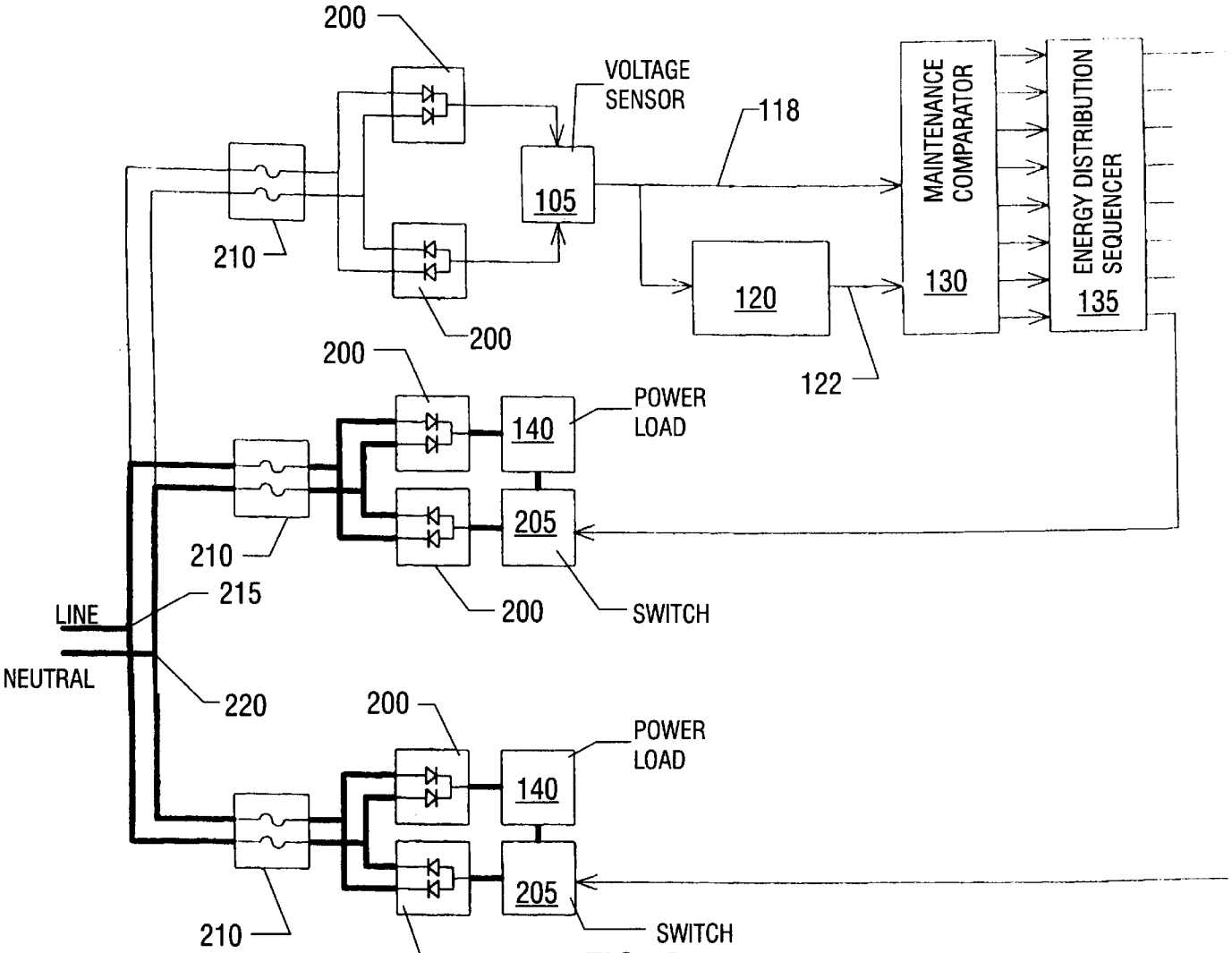
FIG. 2 illustrates a circuit diagram of the shunt voltage regulator of FIG. 1 configured for a single phase power source.
Figure 3:
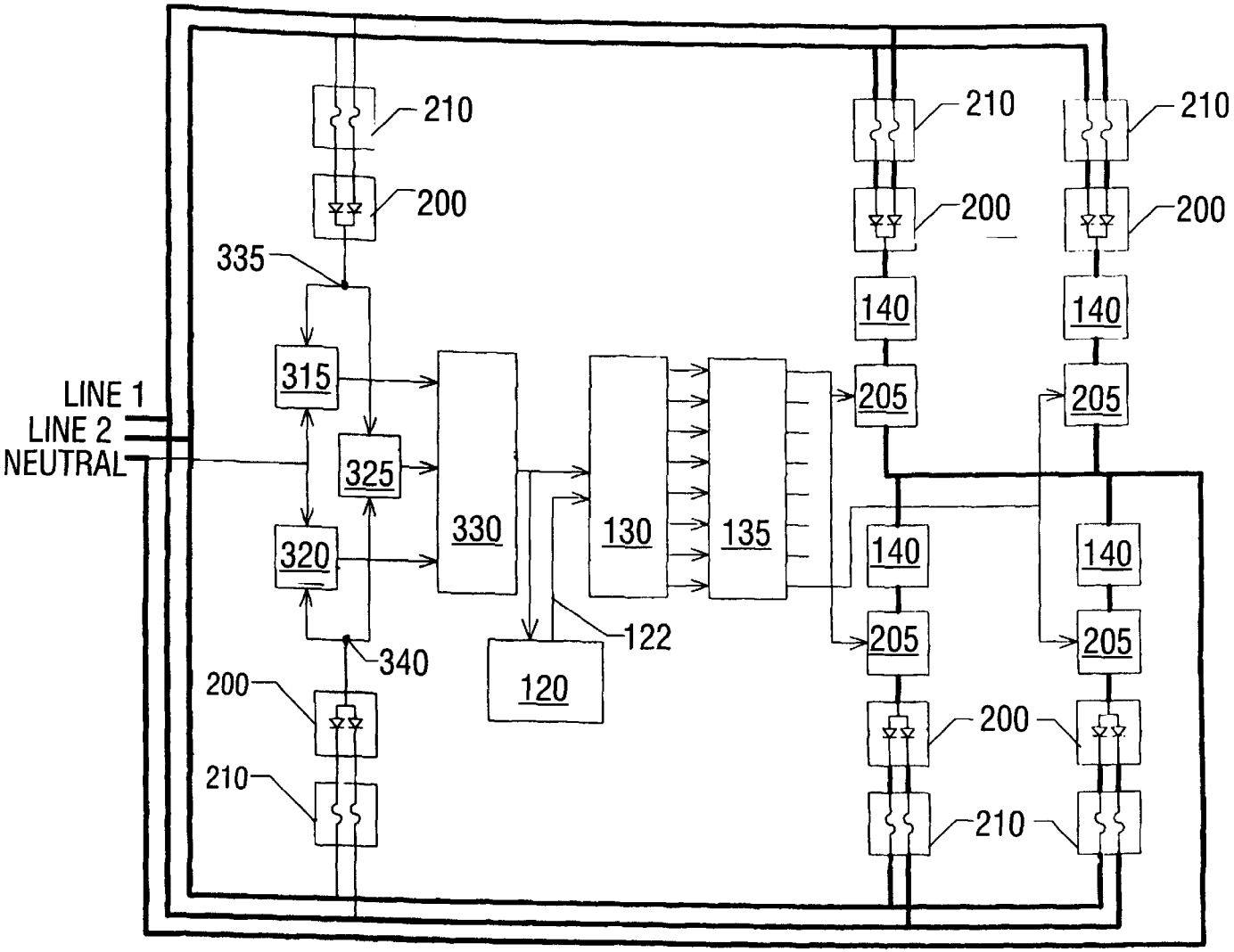
FIG. 3 illustrates a circuit diagram of the shunt voltage regulator of FIG. 1 configured for a split phase power source.
Figure 4:
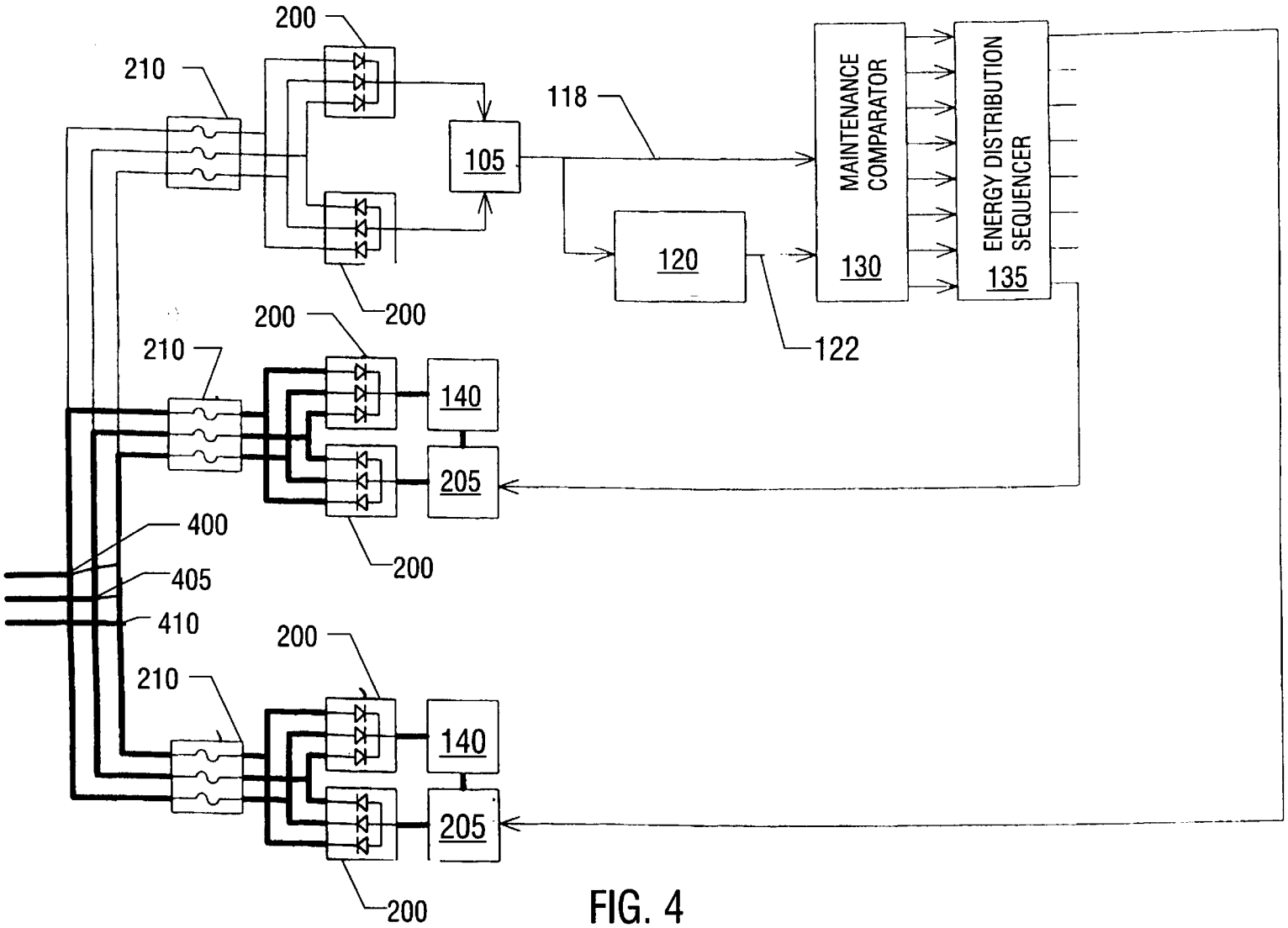
FIG. 4 illustrates a circuit diagram of the shunt voltage regulator of FIG. 1 configured for a three phase, delta configured, power source.

FIGS. 2 through 5 illustrate embodiments of the voltage regulator 100 configured for a variety of power source configurations. For alternating current (AC) applications, rectifiers 200 are used to rectify the input signals in order to allow for the use of unidirectional power switches 205, thus simplifying the resulting circuits. Appropriate fuses 210 are also used to protect elements of the circuit. The unidirectional power switch 205 is preferably a metal oxide silicon field effect transistor (MOSFET), an insulated gate bipolar transistor (IGBT), or a different power semiconductor in a bipolar circuit. In FIGS. 2 through 4, darker lines show high current paths, and the thinner lines indicate control signals. The voltage regulator 100 of the present invention is not limited in its application to a specific power line situation. The voltage regulator 100 may be employed to protect loads associated with single and multi-phase AC circuits operating at 50 hertz, 60 hertz, 400 hertz, as well as DC circuits.

FIG. 2 illustrates the voltage regulator 100 configured with a split phase AC power source. The terminal connections 215, 220 depict line and neutral as commonly found in a household wall outlet. Although only one channel of power switches 205 is shown, the described embodiment includes eight independent channels for redundancy as well as allowing for distribution of energy.

The voltage sensor 105 derives a scaled voltage representative of and proportional to the real time input voltages seen at the terminals 215, 220. The scaled input voltage supplied by the voltage sensor 105 and the output of the reference generator 120 are received by the magnitude comparator 130. The energy distribution sequencer 135 functions to distribute excess energy to the power loads 140 as described above in reference to FIG. 1.

The circuit of FIG. 2 may be adapted for use with a direct current (DC) power source. The rectifiers 200 are not required in a DC application, thus simplifying the circuit. In DC operation, slowly varying voltages would be allowed by the reference generator 120, but unwanted surges would be shunted to the normal voltage seen just before the surge plus a very small offset voltage.

FIG. 3 shows a split phase configuration where the voltage regulator 100 is connected across three terminals 300, 305, 310. Three voltage sensors 315, 320, 325 sense positive peak to neutral, negative peak to neutral, and positive to negative voltages, respectively. A precision full wave rectifier 330 receives the outputs from the voltage sensors 300, 305, 310 and supplies the scaled input signal 118 to the magnitude comparator 130 representative of the rectified and combined outputs. The circuit of FIG. 3 operates in much the same manner as the single phase configuration described in reference to FIG. 2. When a perturbation is sensed by any of the three sensors 315, 320, 325, both the positive peaks and negative peak voltages are clamped to the neutral input. Clamping the voltages in this manner reduces the quantity of control circuitry.

FIG. 4 depicts a delta configuration where there is no neutral input. The voltage regulator 100 is connected across the three phase terminals 400, 405, 410. When any peak to peak voltage is over the normal allowable range as determined by the reference generator 120, the dissipating power loads 140 are engaged to remove the extra unwanted energy and thus control the overall peak to peak voltage of the external phase terminals 400, 405, 410.

Figure 5:
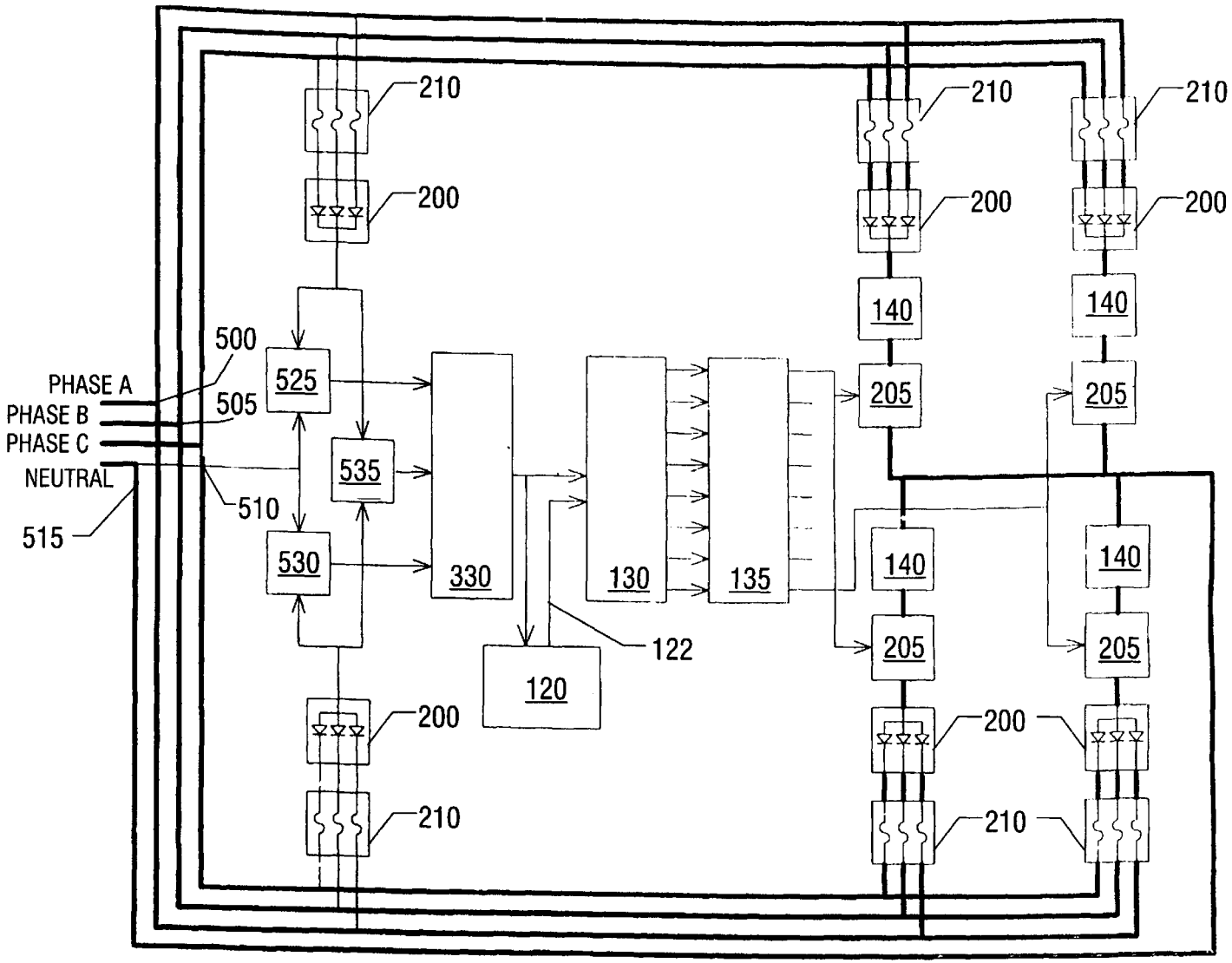
FIG. 5 illustrates a circuit diagram of the shunt voltage regulator of FIG. 1 configured for a three phase, wye configured, power source.

FIG. 5 illustrates a wye configuration which contains a plurality of input lines as well as a neutral. The voltage regulator is connected across the four terminals 500, 505, 510, 515. In this configuration, voltage is sensed by voltage sensors 525, 530, 535 and energy is dissipated in a similar manner as in the split phase configuration described above in reference to FIG. 3. The circuit of FIG. 5 may be modified by adding additional rectifiers 200 to handle any number of input phases.

The functions of the reference generator 120 are described in greater detail in reference to FIG. 6. The reference generator 120 monitors the scaled input signal 118, which is representative of and proportional to the largest of the rectified voltages as described above for the configurations shown in FIGS. 2 through 5. The reference generator 120 outputs a reference voltage signal which is used for the voltage limit in clamping the external terminal voltage.

As shown in FIG. 6, a small fixed voltage from a fixed voltage unit 600 is added to the scaled input signal 118 by a summer 603. The output of the summer 603 may be limited, if desired, by limiter 605 to limit the clamping voltage of the voltage regulator 100.

Lockout sensor 610 handles an undervoltage condition 612. If no undervoltage condition 612 exists, the output of limiter 605 is passed to the integrator 615. If an undervoltage condition 612 is present, the output sent to the integrator 615 is driven high to prevent the load control unit 125 from activating. The lockout sensor 610 is useful during the time when the voltage regulator 100 is powering up and during such time as the voltage regulator power supply has not yet achieved minimum operating voltages. During this time, however, the snubber 150 and MOVs 145 (passive portion) are still connected and ready for use.

The integrator 615 receives the output of the lockout sensor 610 and provides the clamping reference signal 122 output. A feedback loop 620 allows the integrator 615 to slowly adjust the clamping reference signal 122 corresponding to changes in the scaled input signal 118. The integrator slowly increases the clamping reference signal 122 in response to an increasing scaled input signal 118. In the described embodiment, the integrator decreases the clamping reference signal 122 in response to a decreasing scaled input signal 118 at a slower rate than in the increasing case.

The slowly increasing and decreasing functions of the integrator 615 track the incoming line. Line voltage into a residence or into a commercial building varies depending on the number and magnitude of the loads relative to the incoming line impedance. The reference generator 120 adjusts the clamping reference signal 122 to match the normal component of the input signal. The integrator 615 adjusts this value slowly in order to allow the voltage regulator 100 to track the line, but still retain the capability to limit unwanted and abnormal energy injections into the input terminals of the shunting regulator. Because, the reference generator 120 tracks the voltage of the input signal, the clamping reference signal 122 can be set at its lowest possible value, thus providing the greatest degree of protection to the loads attached to the power line being protected.

The slowly increasing function allows the clamping reference signal 122 to increase to a level that decreases the energy dissipated in the power loads 140 in response to a sustained swell. Also, the increasing function may be used to disable the active portion of the voltage regulator 100 at a specified voltage to protect the circuitry from an excessive energy injection into the input terminals of the voltage regulator. In this case, the MOVs 145 are still capable of shunting the voltage at their specified breakdown voltages.

As described above, the voltage regulator 100 encounters an undervoltage condition 612 while powering up. When the lockout sensor 610 is cleared, signifying that the voltage regulator 100 has valid power supplies, the integrator 615 slowly reduces the clamping reference signal 122 from its forced high value to a value corresponding to the scaled input signal 118.

Figure 7:
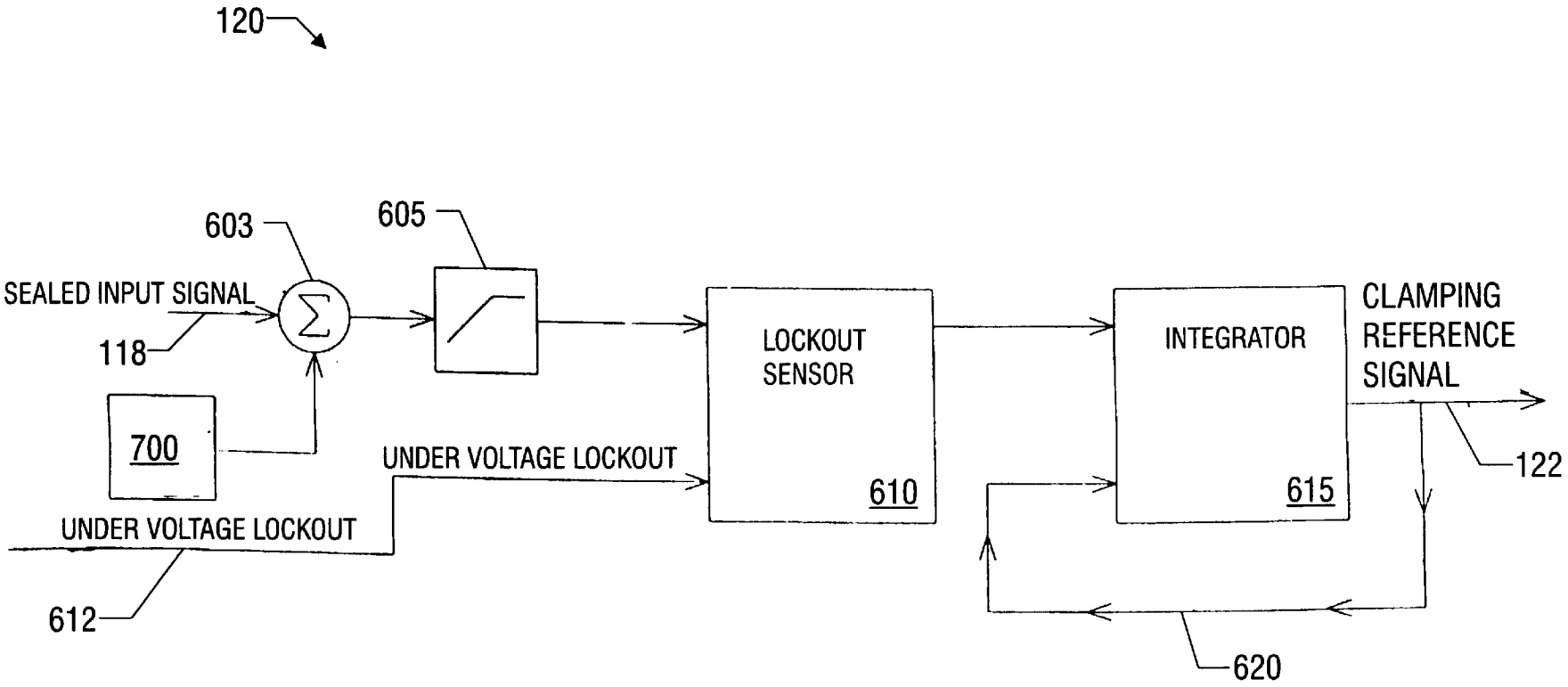
FIG. 7 illustrates a block diagram of the reference generator of FIG. 1 using a proportional voltage offset.

A circuit diagram for an alternate reference generator 120 is shown in FIG. 7. The reference generator 120 in FIG. 7 functions similar to the reference generator of FIG. 6 with the exception of the gain unit 700. Instead of supplying a fixed voltage to the summer 603, the gain unit 700 in FIG.

7 supplies a small percentage of the scaled input signal 118 to the summer 603. In this proportional offset configuration, the difference between the clamping reference signal 122 and the scaled input signal 118 is greater for increasing scaled input signal 118 values.

The integrator 615 may be replaced with a more complex tracking circuit such as a proportional-integral (PI) controller or proportional-integral-derivative (PID) controller to enhance its performance.

It is also contemplated that the reference generator 120 may comprise a clamping reference signal 122 that is set at a fixed voltage reference, and therefore, does not change with changes in the input signal. For example, the clamping reference signal 122 would be set at a level corresponding to 150 volts, and the voltage regulator 100 would start dissipating energy in the power loads 140 if the scaled input signal 118 increased to a level corresponding to an input signal having a voltage greater than 150 volts. Although this configuration is less expensive than the configurations of FIGS. 6 and 7, the voltage regulator 100 would perform less effectively than with the active tracking configurations. This embodiment is desirable over other prior art fixed clamping devices because the power loads 140 are used as the primary means to dissipate unwanted energy, making the voltage regulator more reliable than devices using only MOVs or diodes. Also, this embodiment allows a lower clamping voltage.

Figure 8:
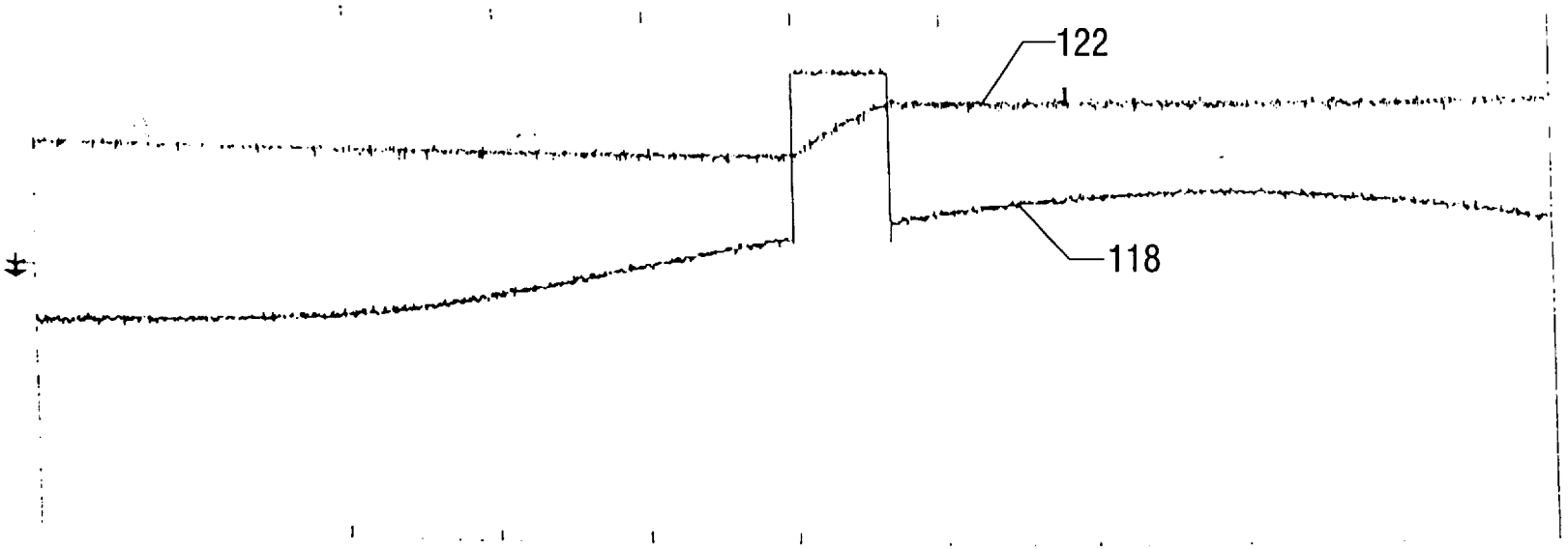
FIG. 8 illustrates the response of the reference generator of FIG. 7 to a short pulse perturbation.
Figure 9:
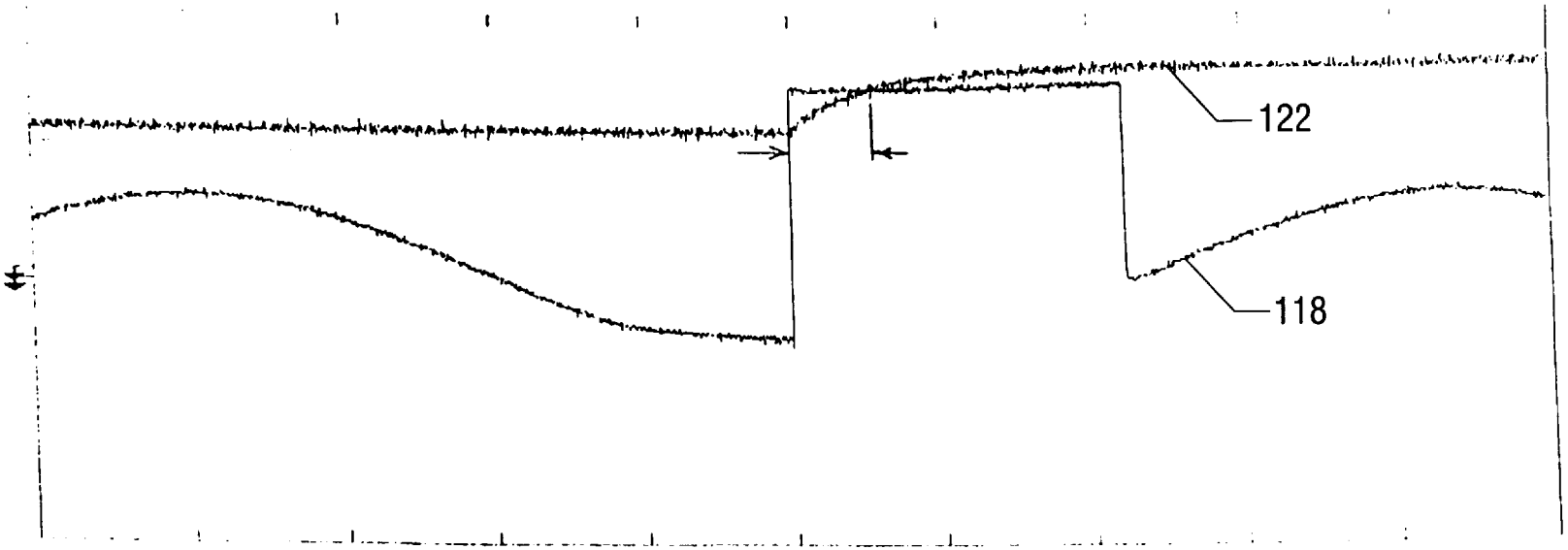
FIG. 9 illustrates the response of the reference generator of FIG. 7 to a long pulse perturbation.
Figure 10:
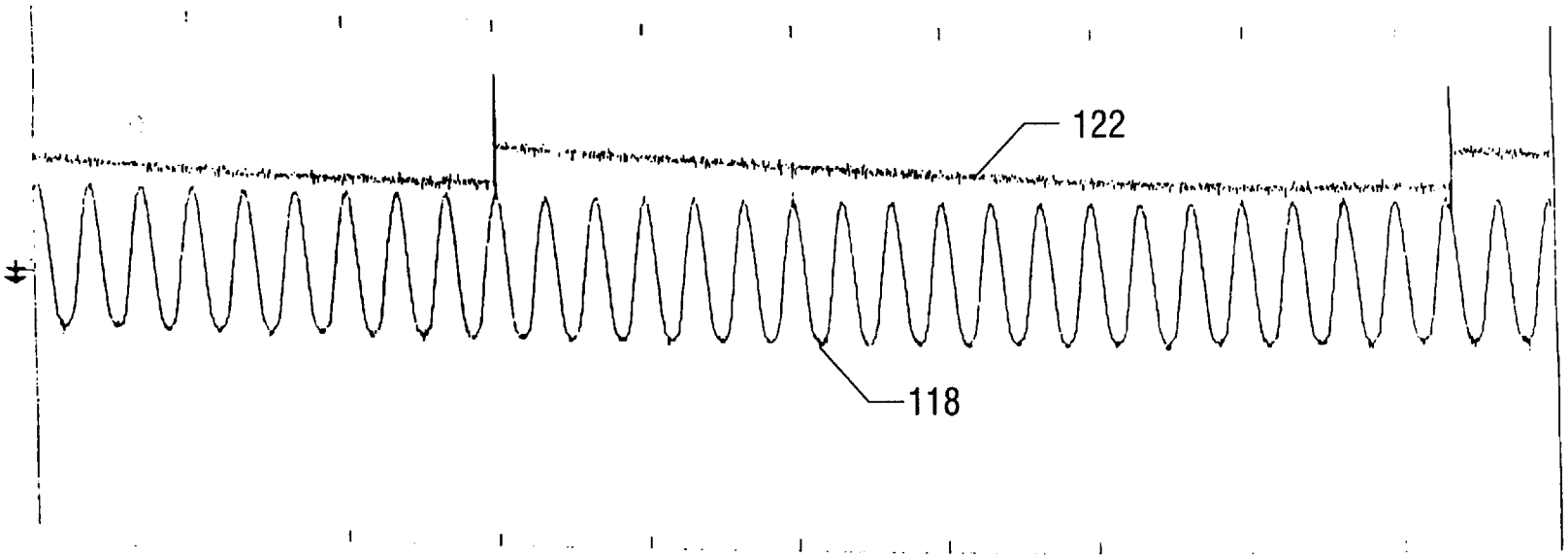
FIG. 10 illustrates the response of the reference generator of FIG. 7 to a repeating spike perturbation.

The response of the reference generator 120 with respect to different scaled input signals 118 is illustrated in FIGS. 8 through 10. The examples show only the response of the reference generator, not the overall response of the voltage regulator 100.

FIG. 8 shows the response of the reference generator 120 due to a short transient pulse. The scaled input signal 118 is a typical sine wave with a single square wave injected on top of the sine wave to show how the reference generator 120 functions during an increasing voltage. As shown in FIG. 8, the clamping reference signal 122 is essentially at a constant voltage both before and after the pulse, but increases significantly during the pulse due to the slowly increasing function of the integrator 615. During the pulse, the clamping reference signal 122, although increasing during the pulse, remains below the pulse. Therefore, during the entire pulse time, the voltage regulator 100 would have shunted some energy away from the incoming line.

FIG. 9 shows the response of the reference generator 120 due to a long transient pulse. The scaled input signal 118 is a typical sine wave with a single square wave injected on top similar to that of FIG. 8. However, in this case the duration of the pulse is sufficient to allow the clamping reference signal 122 to increase beyond the level of the pulse and stop clamping. When the integrator 615 increases the clamping reference signal 122 above the scaled input signal 118, the voltage regulator 100 ceases to dissipate energy. Again, the clamping reference signal 122 was essentially maintained at a constant voltage before and after the pulse and increased during the pulse. This example shows a non-linear ramp in the clamping reference signal 122 during the pulse. However, the reference generator can be configured by adjusting the integrator 615 to provide either a non-linear or a linear ramp. The voltage regulator 100 would have shunted energy away from the incoming line only during the first portion of the pulse as denoted by the arrows shown in FIG. 9.

FIG. 10 shows the response of the reference generator 120 due to a spike, such as might be seen during a lightning transient. The scaled input signal 118 is a 60 hertz sine wave with a spike injected on top. As was the case with the short pulse example described in reference to FIG. 8, the shunt regulator would have clamped during the whole spike because the spike was consistently higher than the clamping reference signal 122, even though the clamping reference signal 122 increased during the spike time. After the spike, however, the integrator 615 slowly decreases the clamping reference signal 122 back to the original voltage representative of the normal component of the input signal before the spike. The voltage regulator 100 is thus ready for another low level clamping activation. During the entire decreasing waveform, the voltage regulator is ready to clamp at higher than normal levels, should an additional transient occur.

If any of the examples had comprised a persistent swell in voltage instead of an isolated transient, the integrator 615 would have increased the clamping reference signal 122 to track the swell, thus allowing the voltage regulator 100 to clamp slightly above the new sine wave magnitude.

Figure 11:
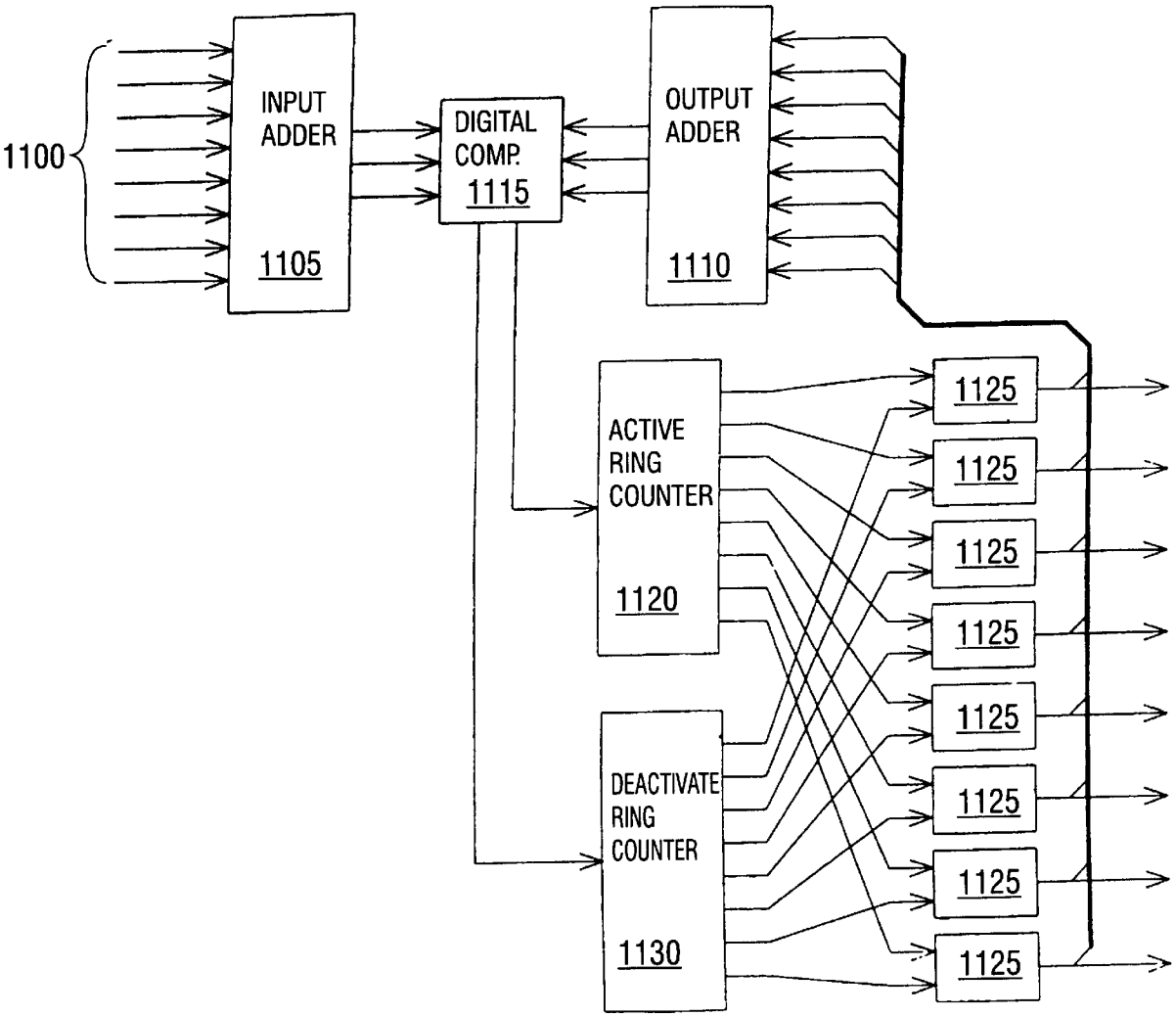
FIG. 11 illustrates a block diagram of the energy distribution sequencer of FIG. 1.

FIG. 11 shows a block diagram of the energy distribution sequencer 135. The energy distribution sequencer 135 receives input bits 1100 from the magnitude comparator 130. The magnitude comparator 130 block compares the scaled input signal 118 to the clamping reference signal 122 and outputs a number of bits 1100 that represent how much larger the scaled input signal 118 is than the clamping reference signal 122. If the scaled input signal 118 is at a voltage equal to or less than the clamping reference signal 122, no bits 1100 are active. If the scaled input signal 118 is slightly higher than the clamping reference signal 122, only a few bits 1100 are active. If the scaled input signal 118 is much larger than the clamping reference signal 122, all of the bits 1100 are active.

The energy distribution sequencer 135 drives the same number of power loads 140 as active bits 1100 that are fed to it by the magnitude comparator 130. The more magnitude comparator 130 input bits 1100 that are active, the more power loads the energy distribution sequencer 135 needs to turn on. During steady state, the energy distribution sequencer 135 will engage the number of loads indicated by the magnitude comparator 130. During a transient, the energy distribution sequencer 135 may have engaged a different number of power loads 140 due to designed in circuit delays between activating and deactivating power loads 140. A small, but finite, time between engaging and disengaging power loads 140 is incorporated to decrease the change of current with respect to time that the snubber 150 must conduct, which directly affects the change of voltage with respect to time at the input terminals 110, 115.

The energy distribution sequencer 135 monitors how many input bits 1100 are active and how many power loads 140 are active. If there are more input bits 1100 active than power loads 140 active, it activates another power load 140. Similarly, if there are less input bits 1100 active than power loads 140 active, it deactivates another power load. As described in more detail below, every time the energy distribution sequencer 135 turns a power load 140 on, it selects the one that has been off longest and every time the sequencer turns a power load off, it selects the one that has been on the longest. This evenly distributes the energy amongst the given loads without causing undo switching losses. Other control methods may be used to better distribute the energy, but such methods employ activating the switches 205 controlling the power loads 140 more often, which inherently causes added switching losses.

The input bits 1100 from the magnitude comparator 130 are received by an input adder 1105. The adder 1105 adds the number of input bits 1100 and outputs the number of active input bits as a binary number. In this case, the input adder provides a three bit output representing eight associated power loads 140. Different configurations will change the number of input bits 1100 and the size of the input adder 1105. An output adder 1110 adds the number of power loads 140 that are engaged. Digital comparator 1115 compares the respective outputs of the input and output adders 1105, 1110.

If the number of input bits 1100 is greater than the number of active power loads 140, the digital comparator 1115, at given time intervals (e.g. 125 nanosecond intervals), sends a pulse to an activate ring counter 1120. The activate ring counter 1120 points to the next power load 140 to activate. When the activate ring counter 1120 receives a pulse from the digital comparator 1115, it sends a signal to the output latch 1125 of the power load 140 corresponding to the next-to-activate value contained in the activate ring counter, and subsequently incerements the next-to-activate value.

If the number of input bits 1100 is less than the number of active power loads 140, the digital comparator 1115, at given time intervals, sends a pulse to a deactivate ring counter 1130. The deactivate ring counter 1130 points to the next power load 140 to deactivate. When the deactivate ring counter 1130 receives a pulse from the digital comparator 1115, it sends a signal to the output latch 1125 of the power load 140 corresponding to the next-to-deactivate value contained in the deactivate ring counter, and subsequently increments the next-to-deactivate value.

The dual ring counter 1120, 1130 configuration allows the energy distribution sequencer 135 to activate the load that has been inactive the longest, and to deactivate the load that has been activated the longest. The ring counters 1120, 1130 may comprise an industry standard 4017 Johnson ring counter.

Figure 12A:
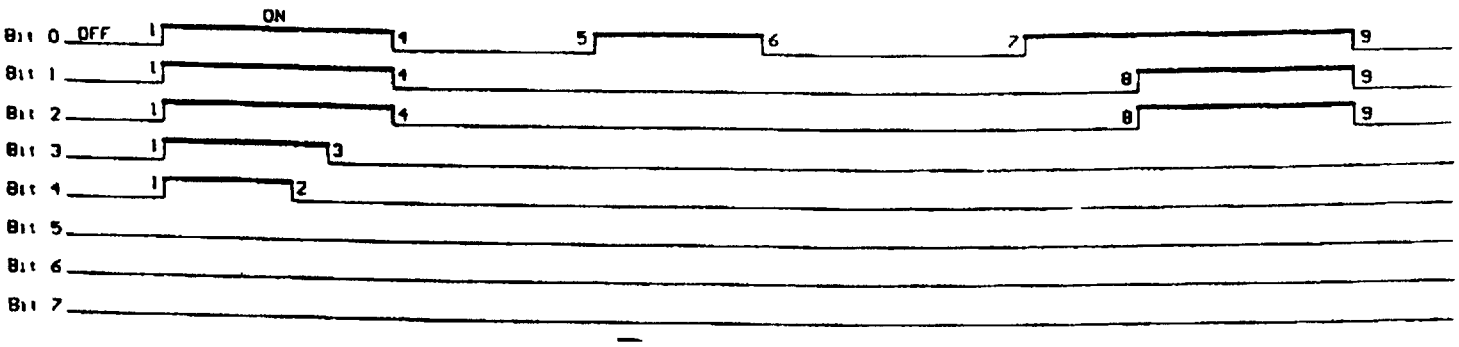
FIGS. 12*a* and 12*b* illustrate a timing diagram showing the operation of the energy distribution sequencer of FIG. 11.
Figure 12B:
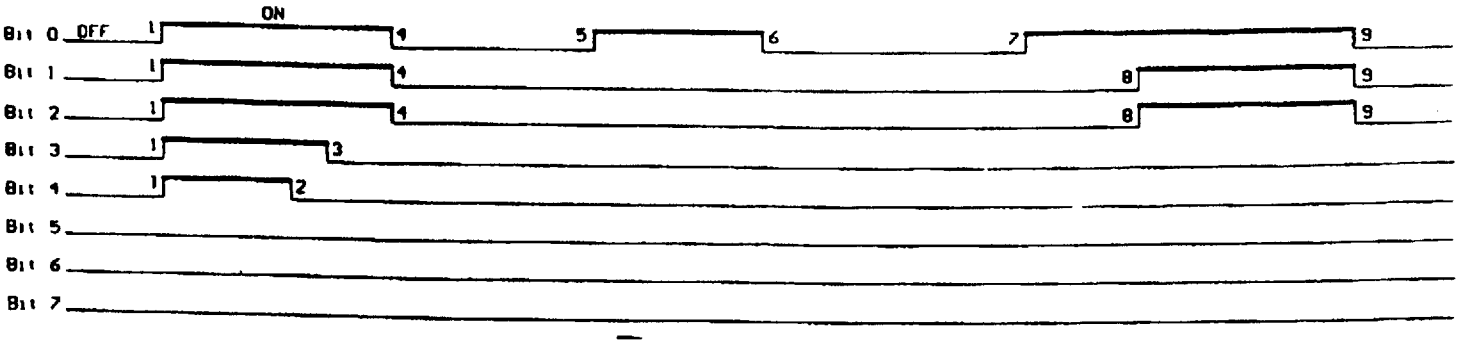

The operation of the energy distribution sequencer 135 is further described in reference to the timing diagrams shown in FIG. 12. The top timing diagram shows a possible set of input bits supplied by the magnitude comparator 130 to the energy distribution sequencer 135 on a time line from left to right. The bottom timing diagram shows the response of the energy distribution sequencer 135 to the input bits 1100.

Eight input bits 1100 and eight output bits representing the signals sent to the power loads 140 are shown. An output signal sent to the output latch 125 corresponding to a power load 140 will be referred to as output N, where N is the associated output bit number. For example, the power load 140 associated with the fifth output latch 125 will be referred to as output 5. The individual numbers from 1 to 9 represent incoming actions from the magnitude comparator 130, and the corresponding actions 1*a* through 9*a* represent the responses of the energy distribution sequencer 135. A thin low line represents a non-active signal and a raised bold line signifies an active signal.

Incoming action (1) activates 5 input bits 1100. The digital comparator 1115 senses the difference between the number of input bits 1100 (5) and the active power loads 140 (0) and sends a pulse to the activate ring counter 1120. Assuming the next-to-activate value stored in the activate ring counter 1120 was 1, the energy distribution sequencer 135 activates output 1 (action 1*a*), and the next-to-activate value is incremented to 2. Again, the digital comparator 1115 senses the difference between the number of input bits 1100 (5) and the active power loads 140 (now 1) and sends a pulse to the activate ring counter 1120. The activate ring counter 1120 cycles until all 5 power loads 140 have been activated (actions 1*b*, 1*c*, 1*d*, and 1*e*). The time delay between activations is controlled to control the snubber 150 current, which in turn controls the voltage at the input terminals 110, 115.

Action 2 deactivates one of the input bits 1100. Assuming the initial next-to-deactivate value stored in the deactivate ring counter 1130 was 1, the energy distribution sequencer 135 deactivates output 1 (action 2*a*), and the next-to-deactivate value is incremented to 2. The energy distribution sequencer 135 thus deactivates the bit that has been activated for the longest time, output 1.

Actions (3) and (4) deactivate all output bits via actions 3*a*, 4*a*, 4*b*, and 4*c*. Next, incoming bit 0 turns back on in action 5, which causes the output bit that has been deactivated longest (output 6) to activate (action 5*a*). The next-to-activate value had been incremented to 6 after the last load (output 5) had been activated due to action 1.

In a similar manner, action 6 turns off output 6 (action 6*a*). Action 7 activates input bit 0, resulting in the activation of output 7 (action 7*a*). Action 8 activates input bits 1 and 2, resulting in the activations of outputs 0 and 1 (actions 8*a* and 8*b*). Action 9 deactivates all input bits, causing outputs 7, 0, and 1 to deactivate in succession.

The timing diagrams above assume ideal circuit conditions. In an actual implementation, the input bits 1100 may not be activated in order due to propagation delays and arbitrary starting values contained in the ring counters 1120, 1130. The starting point and order in which the input bits 1100 and power loads 140 are activated is not important because the input and output adders 1105, 1110 are concerned only with the total number of active inputs and outputs. The ring counters 1120, 1130 will continue to cycle until the number of power loads 140 activated equals the number of input bits 1100.

Figure 13A:
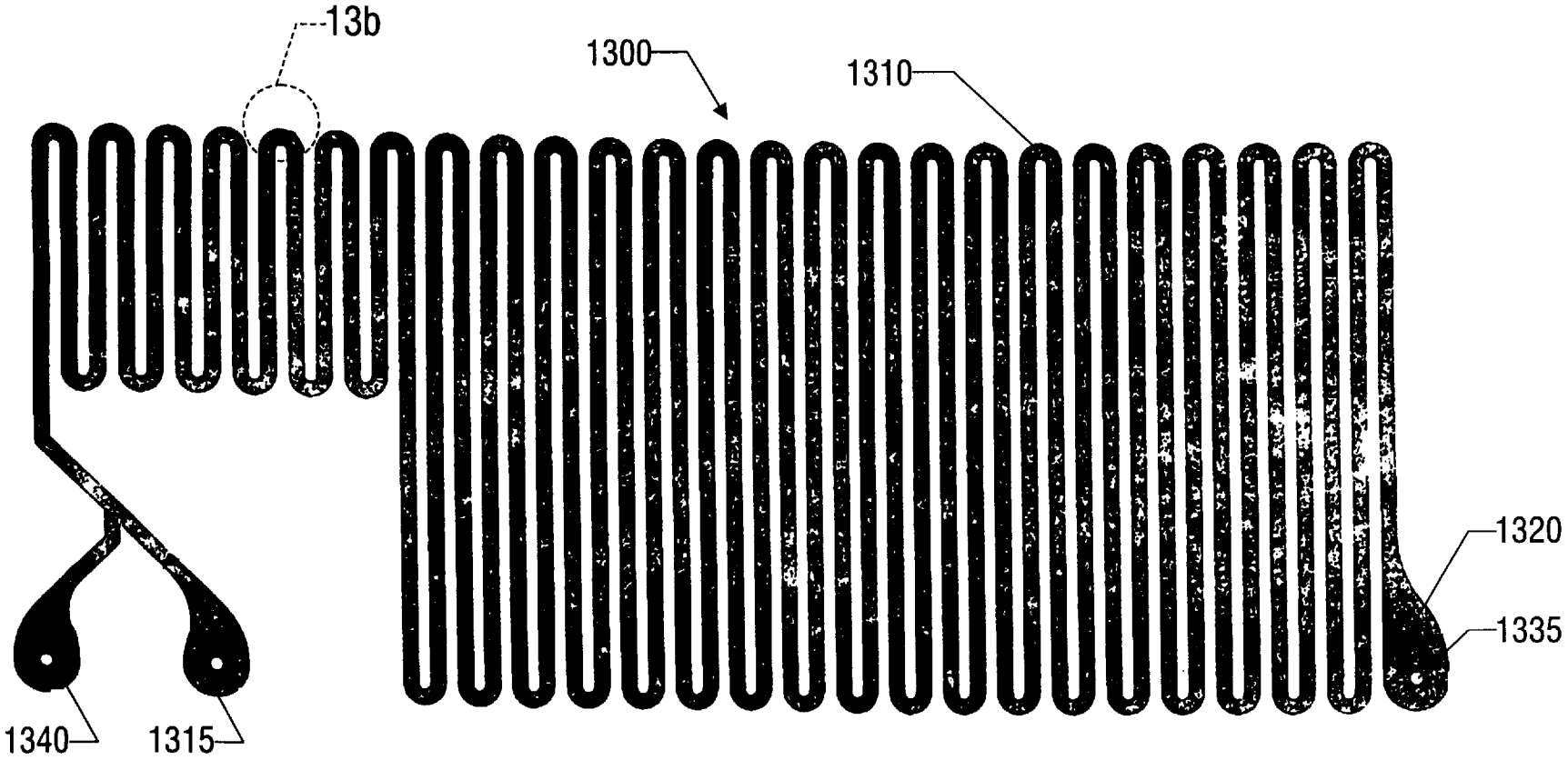
FIG. 13*a* illustrates a printed circuit board resistor.
Figure 13B:
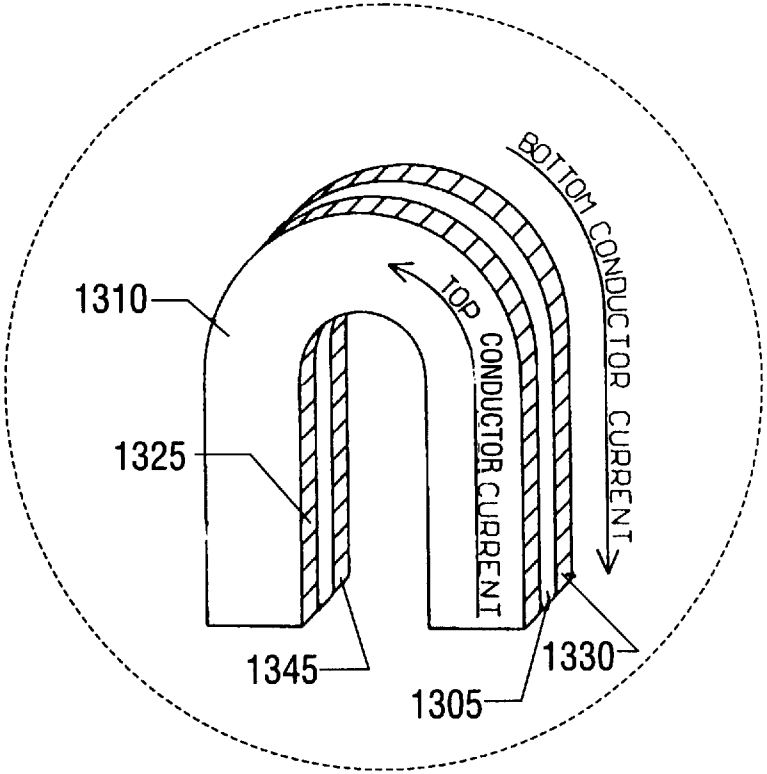
FIG. 13*b* illustrates an exploded isometric view of the printed circuit board resistor of FIG. 13*a;*

An example of a power load 140 of the invention is shown in FIGS. 13*a* and 13*b*. The power load 140 includes a printed circuit board resistor 1300. The resistor 1300 includes a pair of runs disposed on opposing sides of a thin circuit board 1305. The first run 1310 includes first and second terminals 1315, 1320 and is disposed on a first surface 1325 of the circuit board 1305. The second run 1330 includes third and fourth terminals 1335, 1340 and is disposed on a second opposing surface 1345 of the circuit board 1305. A conduction pathway is defined through the circuit board 1305 to allow the second terminal 1320 of the first run 1310 to be electrically connected to the third terminal 1335 of the second run 1330.

The resistor 1300 is disposed on a thin circuit board 1305 with wide runs 1310, 1330. The ratio of run width to board thickness is large, thus causing significant magnetic coupling between the runs 1310, 1330 on opposite sides of the board. As shown in FIG. 13*b*, current travels from the first terminal 1315 on the first side 1325 of the board to the second terminal 1320, through the board to the third terminal 1335, and returns on the opposing side 1345 of the board to the fourth terminal 1340. The resistor terminals 1315, 1320, 1335, 1340 are formed in a teardrop shape to increase the reliability of the produced printed circuit board resistor 1300.

As shown in FIG. 13*b*, the current in the first run 1310 flows in a direction opposite to the current flowing through the second run 1330. The opposing currents and significant magnetic coupling cause the resistor 1300 to exhibit very low inductance. This low inductance allows current to flow very rapidly when the semiconductor switch 205 associated with the power load 140 is activated, thus allowing the voltage regulator 100 to exhibit good voltage regulation.

Also, the low inductance negates the need for a snubber to protect the semiconductor switch 205.

The runs that make up the resistor 1300 are wide to magnetically couple side to side, but are comprised of a very thin conductor, such as copper on the order of ½ ounce per square foot of board area, which is only lightly plated, thus reducing the thermal mass of the runs. A low thermal mass allows the resistor 1300 to increase in temperature rapidly, causing the resistance of the resistor 1300 to also increase rapidly. This increase in resistance is advantageous in decreasing the current through each power load 140. The higher resistance which reduces the current in the resistor 1300, results in a proportional decrease in power dissipation in the semi-conductor switch 205 used to activate the power load 140. The low thermal mass of the resistor 1300 also allows the energy (heat) in the resistor 1300 to dissipate rapidly after an active resistor 1300 has been deactivated, making it ready for another activation.

Figure 24:
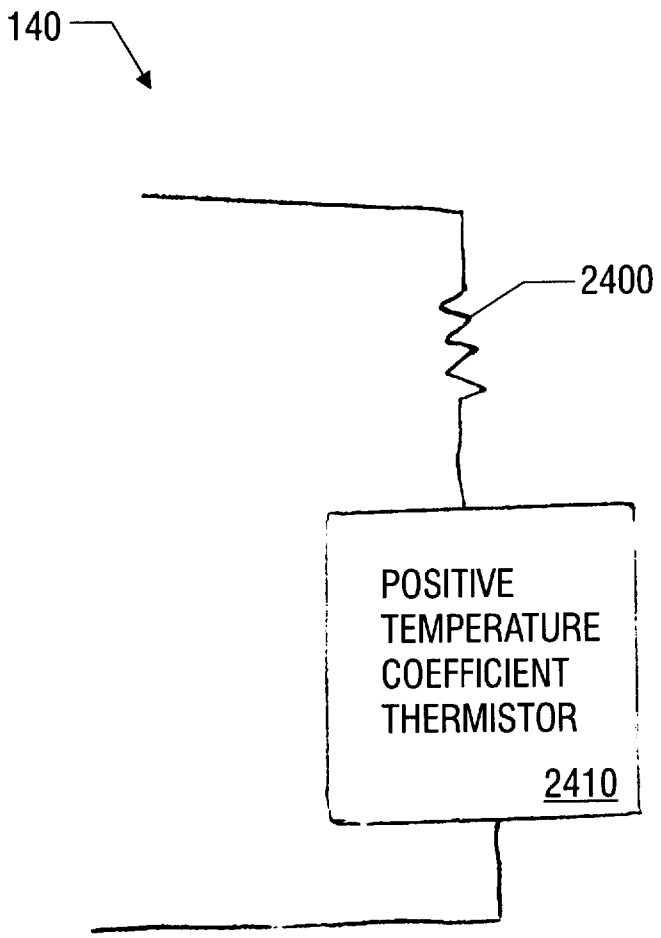
FIG. 24 illustrates an alternative embodiment of a power load.

Conventional power resistors and non-inductive resistors are typically much more expensive than printed circuit board resistors of the type described in FIGS. 13*a* and 13*b*, but could be used as power loads 140. A positive temperature coefficient load (resistance increases as energy dissipation increases) aids in decreasing the current through each power load 140, thereby resulting in a proportional decrease in power dissipation in the semi-conductor switch 205 used to activate the power load 140. As shown in FIG. 24, it is contemplated that a resistor 2400 in series with a positive temperature coefficient thermistor 2410 may be used as a power load 140.

Figure 14:
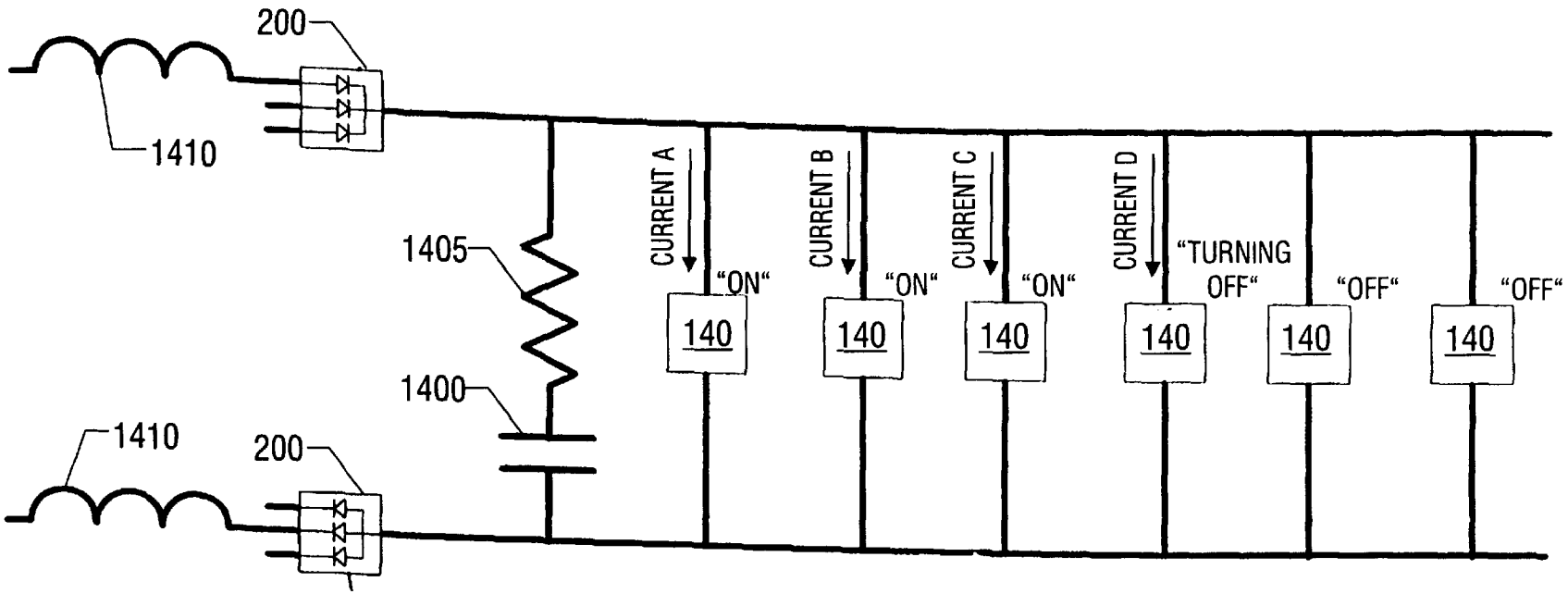
FIG. 14 illustrates a circuit diagram showing the function of the snubber of FIG. 1.

FIG. 14 shows a partial circuit diagram of the invention to illustrate the function of the snubber 150. A capacitor 1400 is in parallel with each of the controlled power loads 140. A single capacitor 1400 is shown, but it is contemplated that the capacitor 1400 comprises several capacitors connected in parallel. The capacitor 1400 serves to store some of the energy resulting from high rate of change perturbations in the input signal until the energy can be absorbed by other loads. Also, the capacitor 1400 and the associated fixed damping resistor 1405 decreases the rate of change in the rectified input signal as each power load 140 disengages. The inductors 1410 represent parasitic inductance from the external power line or transformer.

For example, if 4 power loads are active, causing currents A, B, C, and D to flow, and one load disengages, current D will stop flowing. Assuming there is some finite amount of line inductance, (or added inductance) current D continues to flow into the circuit for a brief time and must be absorbed or dissipated. The capacitor 1400 accommodates that current flow for a brief time. The most critical power load 140 to disengage is the last one. When the last power load 140 deactivates, the current that was flowing into it has no circuit path but into the capacitor 1400. The damping resistor 1405 is added to stop the capacitor 1400 from ringing with external inductance.

Figure 15B:
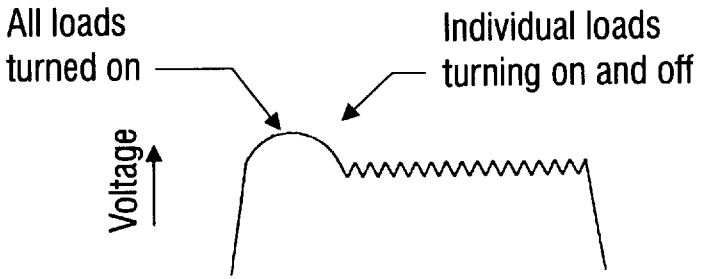
FIGS. 15*a,* 15*b,* and 15*c* illustrate the voltage at the terminals of the shunt voltage regulator shown in FIG. 1 in response to various input signals.
Figure 15A:
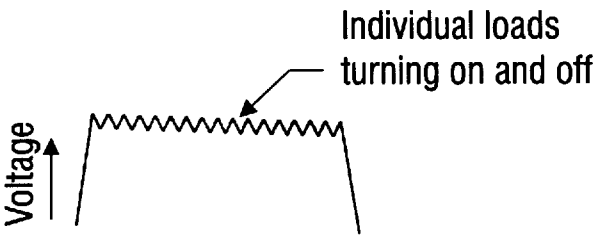
Figure 15C:
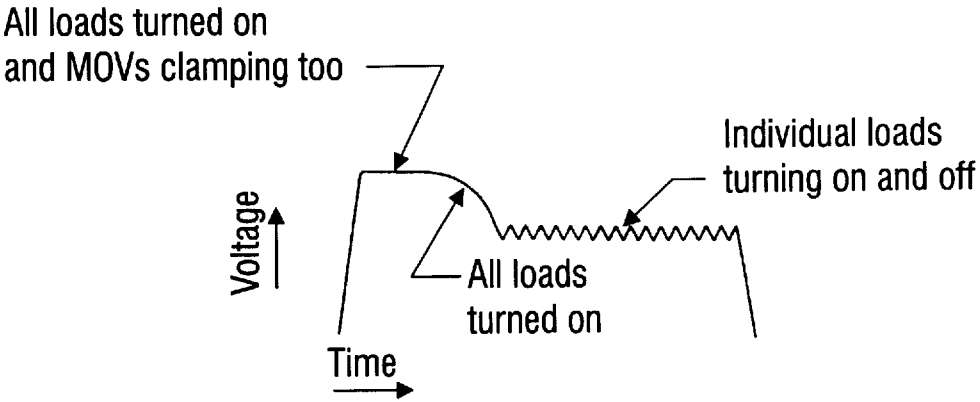

FIGS. 15*a*, 15*b*, and 15*c* illustrate the voltage at the terminals of the shunt voltage regulator shown in FIG. 1 in response to various input signals. FIG. 15*a* illustrates the effect of a small perturbation that can be controlled entirely by the active portion of the circuit. The voltage at the terminals of the voltage regulator has a small ripple on top of the waveform as each power load 140 engages and disengages.

A higher current pulse will engage all of the power loads 140, thus saturating the active portion of the circuit as shown in FIG. 15*b*. With all power loads 140 engaged, the waveform will look like a voltage across a resistor, until a portion of the energy has been dissipated and the remainder can be controlled through cycling the power loads 140.

A very high current will cause a waveform such as is shown in FIG. 15*c*. The waveform is a saturated flat line indicating that all the power loads 140 have been activated and the voltage has risen to a level causing the MOVs 145 to clamp. As the transient energy decreases from this point, the MOVs 145 stop conducting, and the waveform again becomes resistive. Further reduction in the energy will result in the active portion of the circuit controlling the voltage as characterized by the rippled waveform.

The slope seen at the leading edge of the waveforms of FIGS. 15*a*, 15*b*, and 15*c* is controlled by the capacitance of the capacitor 1400 seen in FIG. 14, where the change of voltage with respect to time equals the input current divided by the capacitance of the capacitor 1400.

Exemplary circuits capable of implementing the invention are described in reference to FIGS. 16 through 22. The circuits are described in terms of their major components. Determining individual circuit element values (e.g. resistance and capacitance) is within the ordinary skill of one knowledgeable in the art of voltage regulator design in light of the description herein.

Figure 16:
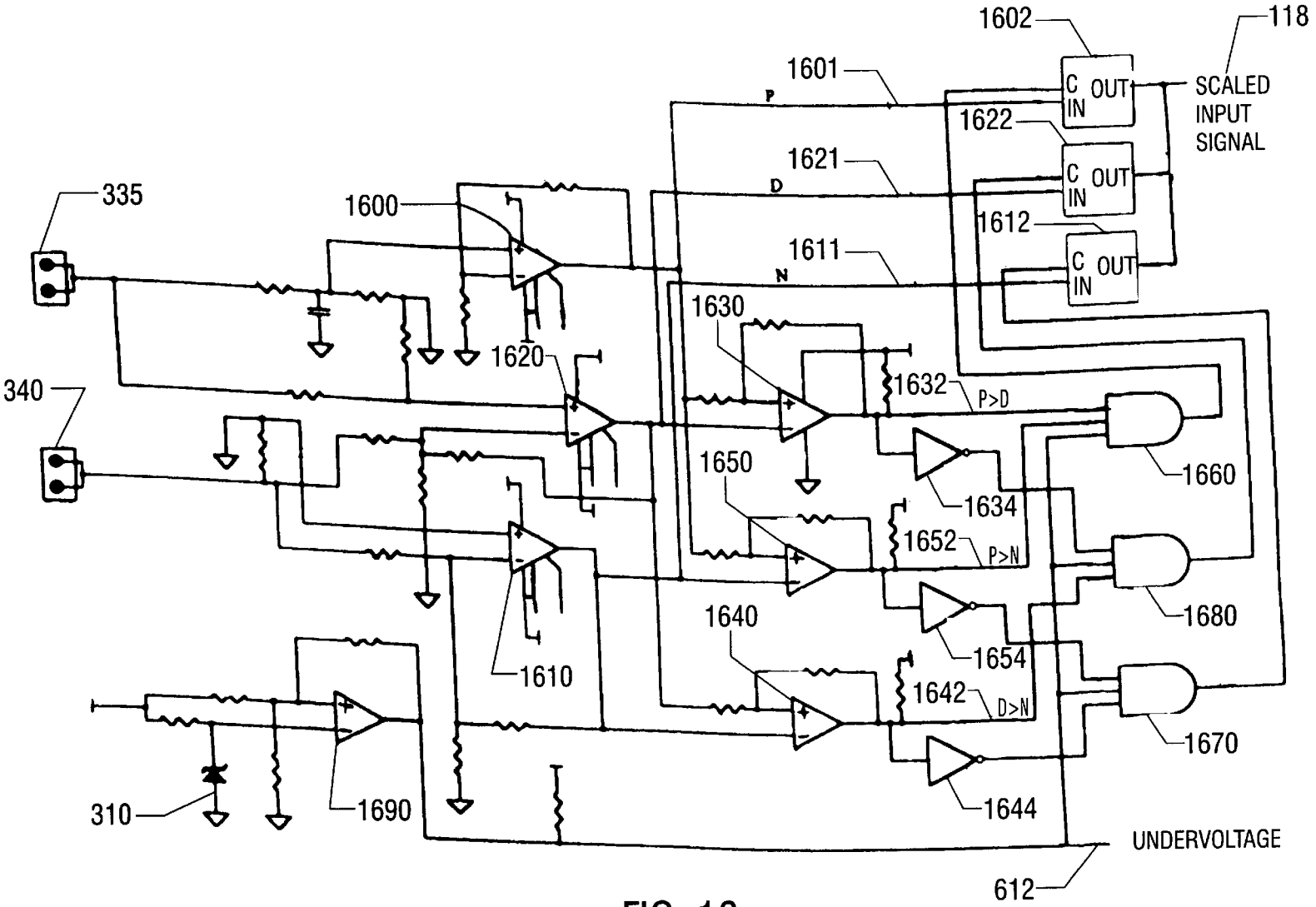
FIG. 16 illustrates a circuit diagram of the voltage sensors and full wave rectifier of FIG. 3.

FIG. 16 is a circuit diagram which provides greater detail regarding the voltage sensors 315, 320, 325 and full wave rectifier 330 shown in FIG. 3. The circuit determines the maximum voltage component which is to be tracked by the reference generator 120.

The positive component of the input signal is provided at a positive terminal 335 and the negative component of the input signal is provided at the negative terminal 340 as seen in FIG. 3. Amplifier 1600 scales the positive component to provide a scaled positive signal 1601. Amplifier 1610 scales the negative component to provide a scaled negative signal 1611. Amplifier 1620 scales the difference between the positive and negative components to provide a scaled difference signal 1621. The scaled positive, negative, and difference signals 1601, 1611, 1621 are provided to a positive analog switch 1602, a negative analog switch 1612, and a difference analog switch 1622, respectively.

Comparator 1630 receives the scaled positive signal 1601 and the scaled difference signal 1621 and provides a P>D output 1632 if the scaled positive signal is greater than the scaled difference signal. Comparator 1640 receives the scaled difference signal 1621 and the scaled negative signal 1611 and provides a D>N output 1642 if the scaled difference signal is greater than the scaled negative signal. Comparator 1650 receives the scaled positive signal 1601 and the scaled negative signal 1611 and provides a P>N output 1652 if the scaled positive signal is greater than the scaled negative signal. Inverters 1634, 1644, 1654 provide the complement to the respective P>D, D>N, and P>N outputs 1632, 1642, 1652.

AND gate 1660 receives the P>D output 1632 and the P>N output 1652 and provides a control signal to positive analog switch 1602. AND gate 1670 receives the inverse of the P>N output 1652 from the inverter 1654 and the inverse of the D>N output 1642 from the inverter 1644 and provides a control signal to negative analog switch 1612. AND gate 1680 receives the D>N output 1642 and the inverse of the P>D output 1632 from the inverter 1634 and provides a control signal to difference analog switch 1602.

Comparator 1690 detects an undervoltage condition 612 and disables the positive, negative, and difference analog switches 1602, 1612, 1622 by sending a logic 0 to their respective AND gates 1660, 1670, 1680. If no undervoltage condition 612 exists, a logic 1 is supplied, and the AND gates 1660, 1670, 1680 are enabled.

The AND gates 1660, 1670, 1680 function to enable the analog switch 1602, 1612, 1622 having the highest value. The output of the enabled analog switch 1602, 1612, 1622 is supplied as the scaled input signal 118 to the reference generator 120. The outputs of the AND gates 1660, 1670, 1680 which enable the analog switch 1602, 1612, 1622 are described in the following truth table.

| UV 1690 | P > D 1632 | D > N 1642 | P > N 1652 | P> 1602 | N> 1612 | D> 1622 |
|---|---|---|---|---|---|---|
| 1 | X | 0 | 0 | 0 | 1 | 0 |
| 1 | 0 | 1 | X | 0 | 0 | 1 |
| 1 | 1 | X | 1 | 1 | 0 | 0 |
| 0 | X | X | X | 0 | 0 | 0 |

X - Don't Care

Figure 17:
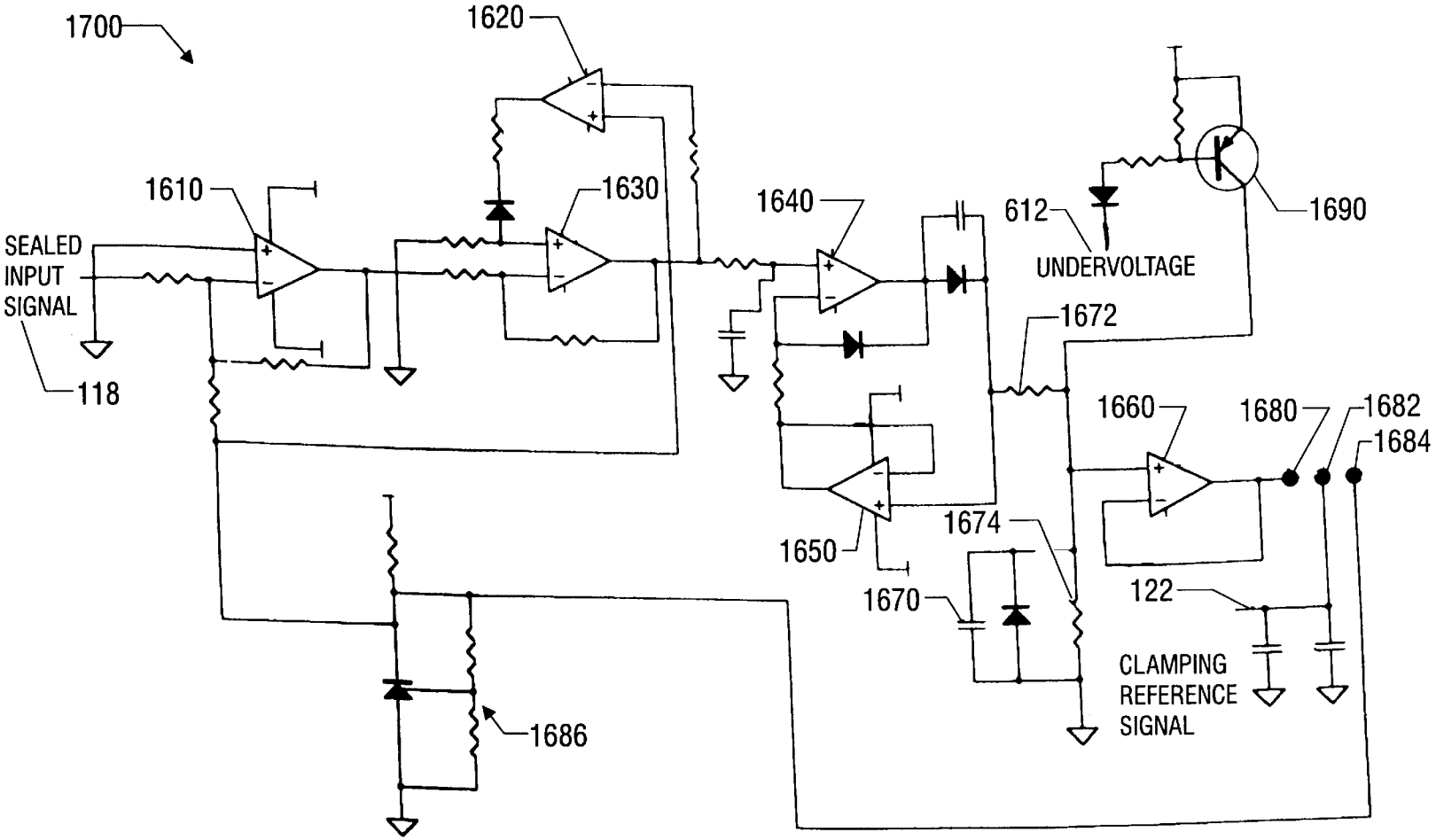
FIG. 17 illustrates a circuit diagram of the reference generator of FIG. 7.

FIG. 17 is a circuit diagram which provides greater detail regarding the reference generator 120. The circuit 1700 of FIG. 17 corresponds to the reference generator 120 configuration shown in FIG. 7. Amplifier 1610 receives the scaled input signal 118 and adds a proportional offset. Amplifier 1610 corresponds to the gain unit 700 and the summer 603 shown in FIG. 7. Limiting amplifiers 1620, 1630 limit the output of amplifier 1610, and rectifying amplifiers 1640, 1650 rectify the output of the limiting amplifiers. The output from the rectifying amplifiers 1640, 1650 is received by buffer 1660. The rate of change in the output of buffer 1660 is controlled by a capacitor 1670 and resistors 1672, 1674. As the magnitude of the output of the rectifying amplifiers 1640, 1650 increases, the capacitor 1670 will charge at a rate determined by the magnitude of the resistor 1672 and the difference in voltage across resistor 1672. As the magnitude of the output of the rectifying amplifiers 1640, 1650 decreases below the voltage across capacitor 1670, the capacitor 1670 will discharge at a rate determined by the magnitude of the resistor 1674. If the resistance of the discharge resistor 1674 is greater than the resistance of the charging resistor 1672, the voltage on the capacitor will decay at a slower rate than it charges. Accordingly, the clamping reference signal 122 will increase at a higher rate than it decreases if the tracking portion of the reference generator 120 is enabled.

To enable the tracking portion of the reference generator 120, the output of the buffer 1660 at pin 1680 is jumpered to pin 1682, which supplies the clamping references signal 122 to the magnitude comparator 130. If pin 1682 is jumpered to pin 1684, the tracking portion of the reference generator 120 is bypassed, and a fixed reference signal is supplied as the clamping reference signal 122. The magnitude of the fixed reference signal is determined by a resistor network 1686. The resistor network 1686 may include a variable resistor for capable of varying the magnitude of the fixed reference signal.

If an undervoltage condition 612 exists, transistor 1690 conducts and forces the voltage at the buffer 1660 high, as is discussed above in reference to the lockout sensor 610 of FIG. 7.

Figure 18:
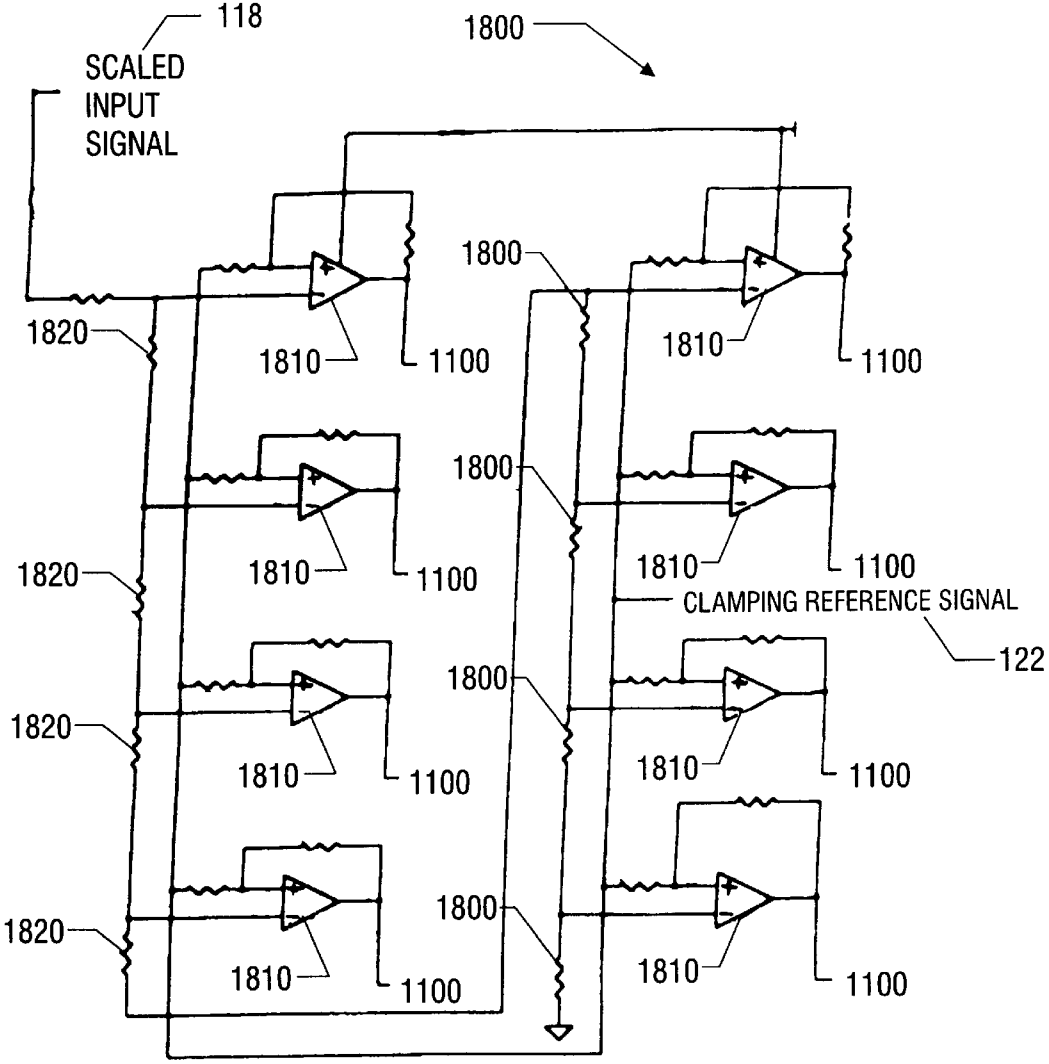
FIG. 18 illustrates a circuit diagram of the magnitude comparator of FIG. 1.

FIG. 18 is a circuit diagram which provides greater detail regarding the magnitude comparator 130. The magnitude comparator circuit 1800 receives the scaled input signal 118 and the clamping reference signal 122. Comparators 1810 are separated by series resistors 1820 having essentially the same resistance value. Due to the series resistors 1820, the voltage seen at the first comparator 1810 is greater than the voltage seen at the subsequent comparators. As the magnitude of the difference between the scaled input signal 118 and the clamping reference signal 122 increases the voltage seen at the terminals of the comparators 1810 will be sufficient to trigger each subsequent comparator in sequence. If the difference between the scaled input signal 118 and the clamping reference signal 122 is sufficiently large all such comparators 1810 will be triggered. The outputs of the comparators 1810 provide the input bits 1100 to the energy distribution sequencer shown in FIG. 11.

Figure 19:
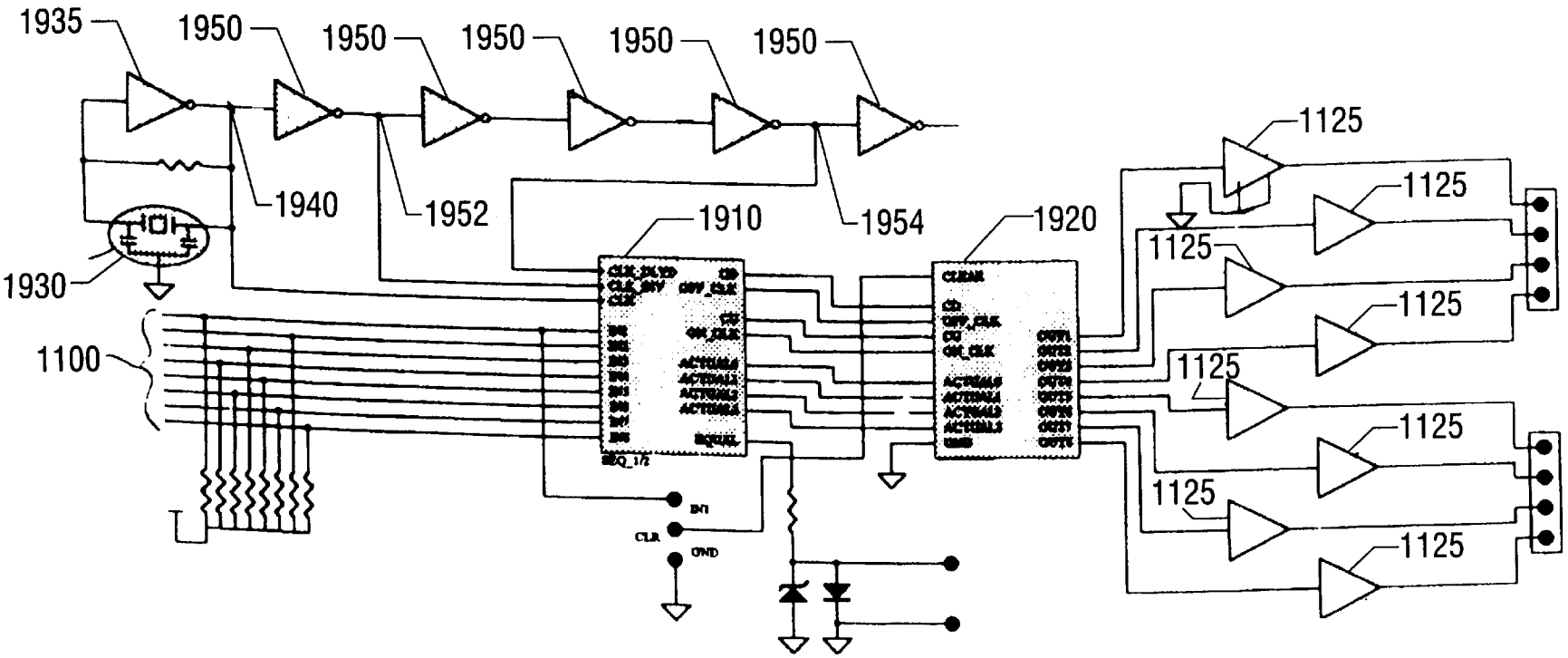
FIG. 19 illustrates a circuit diagram of the energy distribution sequencer of FIG. 11.

A circuit diagram of the sequencer of FIG. 11 is shown in FIG. 19. Programmable array logic devices (PAL) 1910, 1920 are programmed to provide the functionality of the input adder 1105, the output adder 1110, the digital comparator 1115, and the ring counters 1120, 1130. PAL 1910 receives the input bits 1100 from the magnitude comparator 130 and a clock signal 1940 from a resonant circuit comprised of a resonator 1930 and an inverter 1935. Inverters 1950 provide an inverted clock signal 1952 and a delayed clock signal 1954 to the PAL 1910. PAL 1920 provides the output signals to the output latches 1125 of the power loads 140. Although two PALs 1910, 1920 are shown in FIG. 19, the circuit may be embodied on a single PAL.

Figure 20:
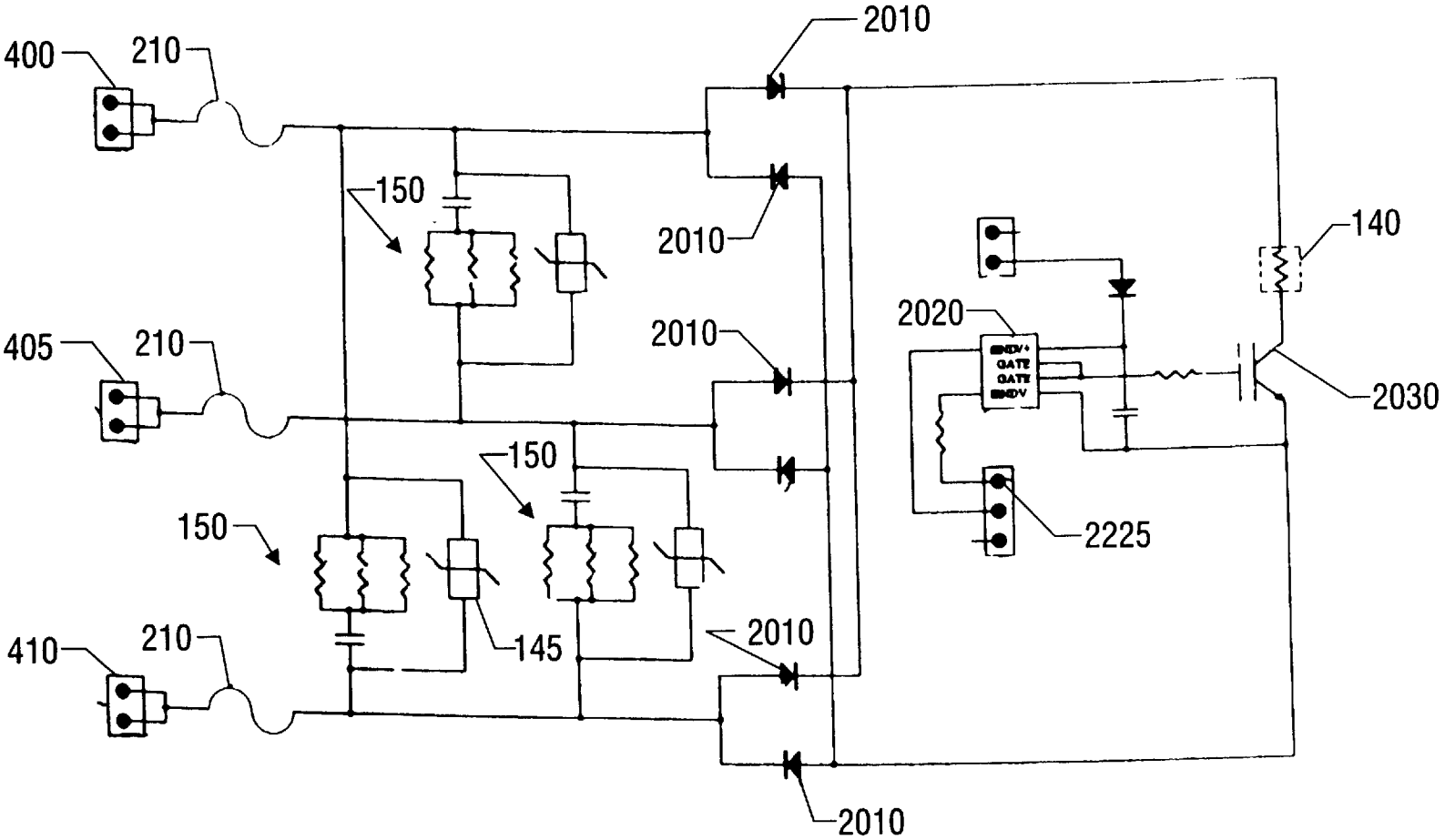
FIG. 20 illustrates a circuit diagram for connecting a power load to a three phase, delta configured power source.

FIG. 20 is a circuit diagram which illustrates the connection of the power load 140 in a three-phase, delta connected circuit, such as shown in FIG. 4. Only one power load 140 is illustrated, but a similar circuit is present for each power load. The three-phase input signal is received at input terminals 400, 405, 410. Fuses 210 are provided to protect the circuit elements. Snubbers 150 are provided for each of the phases. Although the illustrated snubbers 150 include resistors and a capacitor, the snubber may consist of a capacitor without accompanying resistors. MOVs 145 are provided for each phase. Diodes 2010 rectify the input signals. A gate driver 2020 provides the gate drive input of an isolated gate bipolar transistor (IGBT) 2030. The gate driver 2020 activates the IGBT 2030 to dissipate power in the power load 140 based on signals from the output latches 1125 of the energy distribution sequencer 135. The IGBT 2030 also receives the low side gate drive signal (LSRTN) 2260 from the power supply, which is discussed below in greater detail in reference to FIG. 22.

Figure 21:
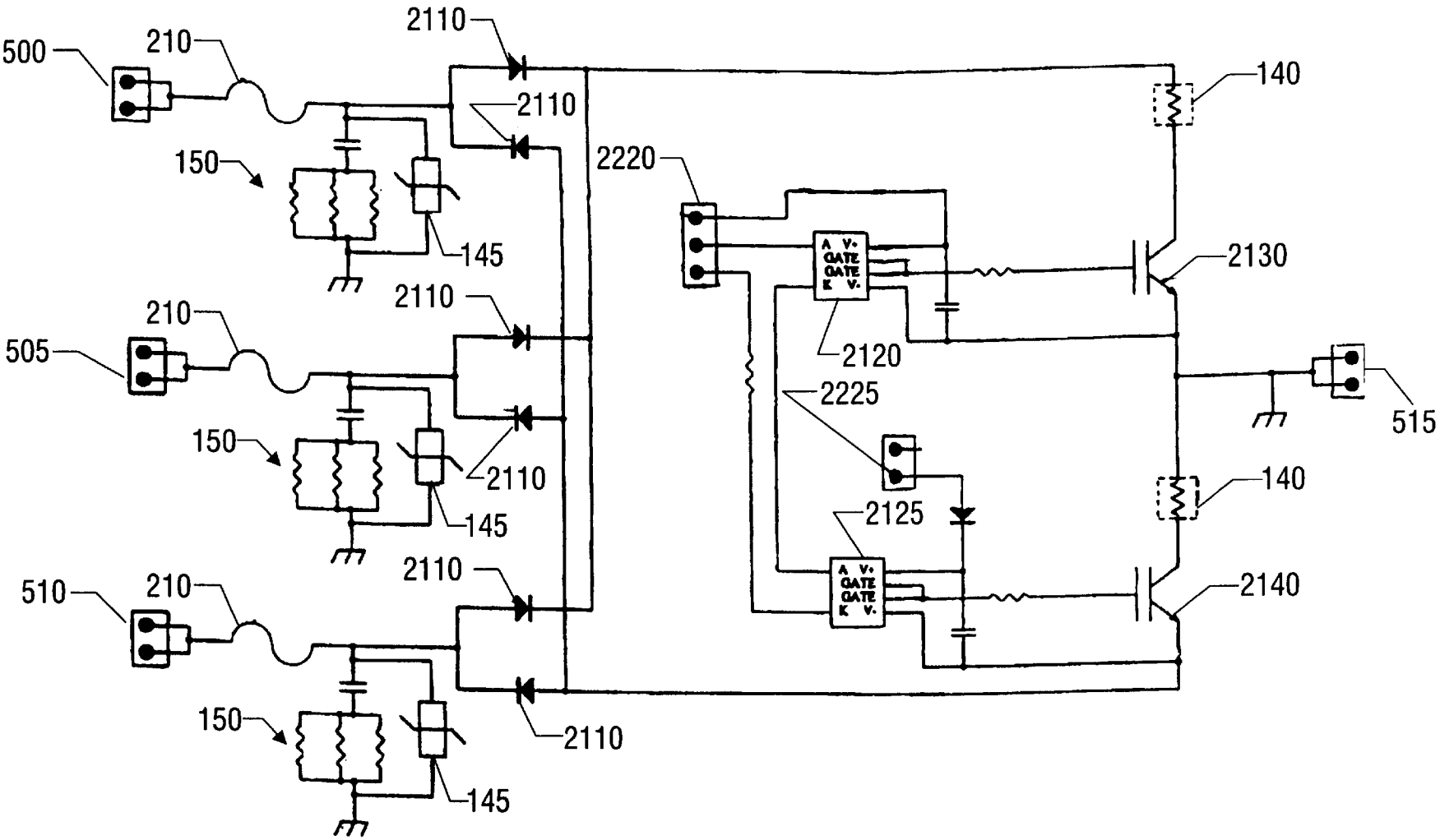
FIG. 21 illustrates a circuit diagram for connecting a power load to a three phase, wye configured power source.

FIG. 21 is a circuit diagram which illustrates the connection of the power load 140 in a three-phase, wye connected circuit, such as shown in FIG. 5. Only two power loads 140 are illustrated, but a similar circuit is present for each pair of power loads. The three-phase input signal is received at input terminals 500, 505, 510, and the neutral is received at terminal 515. Fuses 210 are provided to protect the circuit elements. Snubbers 150 are provided for each of the phases. Although the illustrated snubbers 150 include resistors and a capacitor, the snubber may consist of a capacitor without accompanying resistors. MOVs 145 are provided for each phase. Diodes 2110 rectify the input signals. Gate drivers 2120 provide the gate drive inputs for the isolated gate bipolar transistors (IGBT) 2130, 2140. The gate drivers 2120 activate the IGBTs 2130, 2140 to dissipate power in the power loads 140 based on signals from the output latches 1125 of the energy distribution sequencer 135. IGBT driver 2120 receives input power from the power supply high side gate drive signal 2220, and is referenced to the emitter of the IGBT 2130. IGBT driver 2125 receives input power from the power supply low side gate drive signal 2225 and is referenced to the emitter of the IGBT 2140. The power supply is discussed below in greater detail in reference to FIG. 22.

Figure 22:
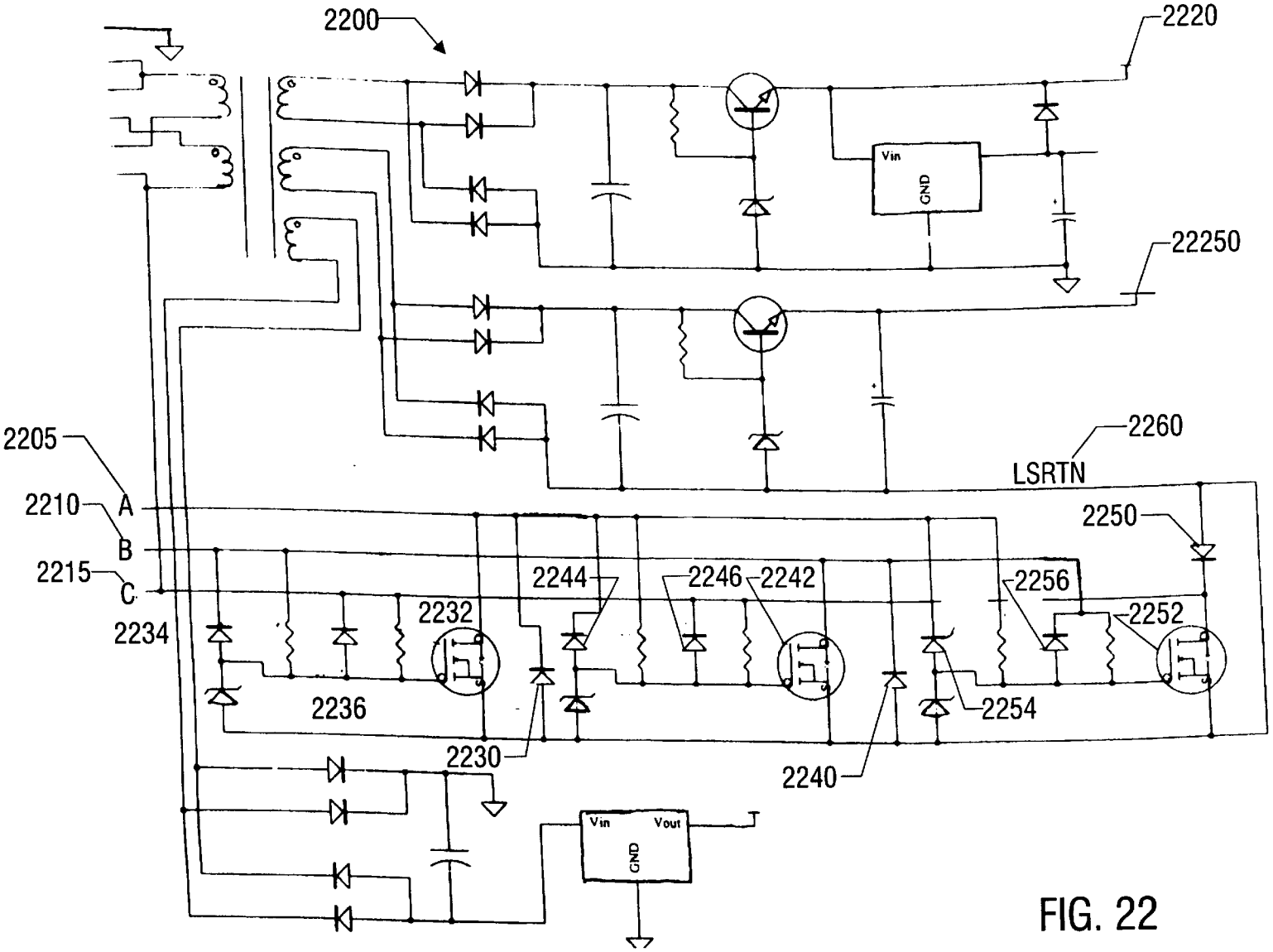
FIG. 22 illustrates a circuit diagram for the power supply of the shunt voltage regulator of FIG. 1.

FIG. 22 is a circuit diagram for the power supply 2200 of the voltage regulator 100. The power supply 2200 receives three phase input voltages (A, B, C, respectively) 2205, 2210, 2215. There are several ways to power the gate drivers for the IGBT power switches 205. Conventional power supply circuits include either separate power supplies for the gate drivers of each phase or magnetically coupled gate drivers which supply both power and control signals.

The power supply circuit 2200 in FIG. 22 uses a common power supply to power the IGBTs. The circuit of FIG. 21 will be discussed in conjunction with the power supply 2200 circuit of FIG. 22. When using a common power supply to power the gate drivers 2120, 2125, it is necessary to provide a high side gate drive signal (HSGD) 2220 and a low side gate drive signal (LSGD) 2225. The LSGD 2225 is supplied as the negative reference voltage to the gate driver 2125. The LSRTN 2260 is maintained at a voltage essentially equal to the lowest of the three phase voltages 2205, 2210, 2215.

Diodes 2230, 2240, 2250 are connected between each of the respective phases (A, B, C) and the low side return (LSRTN) 2260. The combination of the three diodes 2230, 2240, 2250 result in the LSRTN 2260 being equal to the lowest of the three phase inputs A, B, C. However, if only the three diodes 2230, 2240, 2250 were provided, the power supply could not deliver power to drive the gate drivers 2020, 2120, 2125, because the diodes are not bidirectional. Accordingly, additional circuit elements are necessary to allow the power supply to power the gate drivers.

If phase A is the lowest of the three phase voltages, diode 2230 will conduct. A MOSFET 2232 connected between phase A and the LSRTN 2260 will also conduct. If phase B becomes more negative than phase A, a diode 2234 connected between phase B and the gate terminal of the MOSFET 2232 will conduct, thus disabling the MOSFET. Because phase B is now the lowest, diode 2240 and MOSFET 2242 will conduct. Diode 2244 will disable the MOSFET 2242 if phase A becomes lower than phase B, and diode 2246 will disable the MOSFET 2242 if phase C becomes more negative than phase B.

Likewise, if phase C becomes more negative than phase A, a diode 2236 connected between phase C and the gate terminal of the MOSFET 2232 will conduct, thus disabling the MOSFET. Because phase C is now the lowest, diode 2250 and MOSFET 2252 will conduct. Diode 2254 will disable the MOSFET 2252 if phase A becomes lower than phase C, and diode 2256 will disable the MOSFET 2252 if phase B becomes more negative than phase C.

As a result the diode 2230, 2240, 2250 and MOSFET 2232, 2242, 2252 associated with the most negative phase will supply the LSRTN 2260, which in turn provides the LSGD 2225 signal to the gate driver 2125, 2020.

While the invention is susceptible to various modifications and alternative forms, specific embodiments have been shown by way of example in the drawings and have been described in detail herein. However, it should be understood that the invention is not intended to be limited to the particular forms disclosed. It will be appreciated by those of ordinary skill having the benefit of this disclosure that numerous variations from the foregoing illustrations will be possible without departing from the inventive concept described herein. Accordingly, it is the claims set forth below, and not merely the foregoing illustration, which are intended to define the exclusive rights claimed in this application.

What is claimed is:

1. A voltage regulator for regulating a power source that supplies an input signal, comprising:

input terminals connected across the power supply;

a voltage sensor connected across the input terminals that receives the input signal and generates a scaled input signal from the input signal that is a fraction of the input signal in magnitude;

a reference generator that receives the scaled input signal from the voltage sensor and generates a reference signal;

a variable load unit connected across the input terminals; and a control unit that receives and compares the scaled input signal and the reference signal and controls the variable load unit to dissipate a first portion of the input signal if the scaled input signal exceeds the reference signal.

2. The voltage regulator as defined in claim 1, further comprising a snubber device connected across the input terminals adapted to at least partially store a second portion of the input signal resulting from high rate of charge perturbations in the input signal.

3. The voltage regulator as defined in claim 2, wherein the snubber device includes a capacitor.

4. The voltage regulator as defined in claim 3, wherein the snubber device includes a damping resistor in series with the capacitor.

5. The voltage regulator as defined in claim 1, wherein the variable load unit includes a plurality of power loads, and the control unit selectively activates or deactivates one or more of the plurality of power loads depending upon the magnitude of the difference between the scaled input signal and the reference signal.

6. The voltage regulator as defined in claim 5, further comprising a snubber device connected across the input terminals adapted to store any energy remaining in any of the power loads that have been deactivated.

7. The voltage regulator as defined in claim 6, wherein the snubber device includes a capacitor.

8. The voltage regulator as defined in claim 7, wherein the snubber device includes a damping resistor in series with the capacitor.

9. The voltage regulator as defined in claim 5, wherein the control unit selects for activation of the power load that has been deactivated least recently.

10. The voltage regulator as defined in claim 5, wherein the control unit selects for deactivation the power load that has been activated least recently.

11. The voltage regulator as defined in claim 5, wherein the control unit includes:

a magnitude comparator connected to the voltage sensor and the reference generator and adapted to receive the scaled input signal and the reference signal, the magnitude comparator having a plurality of demand bits, the number of demand bits being equal to the number of power loads, the magnitude comparator activating or deactivating the demand bits based on the magnitude of the difference between the scaled input signal and the reference signal; and an energy distribution sequencer connected to the magnitude comparator and the plurality of power loads and adapted to receive the demand bits, including:

an input adder adapted to provide a demand sum equal to the number of active demand bits, an output adder adapted to provide an active sum equal to the number of active power loads, a digital comparator adapted to compare the demand sum and the active sum and provide an activate signal if the demand sum is greater than the active sum and a deactivate signal if the demand sum is less than the active sum, a first ring counter containing a next-to-activate value, the first ring counter adapted to activate the power load corresponding to the next-to-activate value and increment the next-to-activate value upon receipt of the activate signal, and a second ring counter containing a next-to-deactivate value, the second ring counter adapted to deactivate the power load corresponding to the next-to-deactivate value and increment the next-to-deactivate value upon receipt of the deactivate signal.

12. The voltage regulator as defined in claim 5, wherein in each of the plurality of power loads comprises a printed circuit board resistor, including:

a circuit board having top and bottom surfaces and a connection pathway defined through the circuit board communicating with the top and bottom surfaces;

a first conductor run having first and second terminals disposed on the top surface;

a second conductor run having third and fourth terminals disposed on the bottom surface overlaying the first conductor run; and wherein the second and third terminals are connected through the connection pathway, the first conductor run follows a first path, the second conductor run follows a second path similar to the first path, and the first and second conductor runs are magnetically coupled.

13. The voltage regulator as defined in claim 12, wherein each of the first and second paths comprise a serpentine path, the width of the serpentine path being large as compared to the width of the first and second conductor runs.

14. The voltage regulator as defined in claim 12, wherein each of the first and second conductor runs comprise a conducting material having a resistance that increases as the energy dissipated in the first and second conductor runs increases.

15. The voltage regulator as defined in claim 5, wherein the power source comprises a multi-phase, alternating current power source having a plurality of phase voltages, further comprising:

a gate driver connected to the control unit;

a power switch connected to the gate driver and one of the power loads; and a power supply adapted to provide a low side gate drive signal corresponding to the most negative of the phase voltages to the gate driver.

16. The voltage regulator as defined in claim 5, wherein each of the plurality of power loads comprises a resistor having a negligible inductance.

17. The voltage regulator as defined in claim 5, wherein each of the plurality of power loads comprises a positive temperature coefficient load.

18. The voltage regulator as defined in claim 5, wherein each of the plurality of power loads comprises a resistor in series with a positive temperature coefficient thermistor.

19. The voltage regulator as defined in claim 1, wherein the reference generator includes:

a gain unit adapted to provide a first reference control signal;

a summer adapted to add the scaled input signal to the first reference control signal to provide a second reference control signal; and an integrator adapted to receive the second reference control signal and provide the reference signal, wherein the integrator increases the reference signal at a first rate if the reference signal is less than the second reference control signal and decreases the reference signal at a second rate if the reference signal is greater than the second reference control signal.

20. The voltage regulator as defined in claim 19, wherein the first reference control signal comprises a fixed voltage.

21. The voltage regulator as defined in claim 19, wherein the first reference control signal comprises a fraction of the scaled input signal.

22. The voltage regulator as defined in claim 19, wherein the reference generator includes a voltage limiter connected to the summer and adapted to limit the magnitude of the first reference control signal.

23. The voltage regulator as defined in claim 19, wherein the scaled input signal comprises a transient component having a magnitude changing at a transient rate and the first and second rates are less than the transient rate.

24. The voltage regulator as defined in claim 19, wherein the first rate is greater than the second rate.

25. The voltage regulator as defined in claim 1, wherein the input signal comprises a direct current signal.

26. The voltage regulator as defined in claim 1, wherein the power source comprises a multi-phase, alternating current power source having a first line, a second line, and a neutral line, the voltage regulator including a plurality of rectifiers connected to the power source and the voltage sensor and adapted to rectify positive voltage portions of the input signal present on the first and second lines to provide a positive component signal and to rectify negative voltage portions of the input signal present on the first and second lines to provide a negative component signal, wherein the voltage sensor generates the scaled input signal from the combination of the positive component signal and the negative component signal.

27. The voltage regulator as defined in claim 26, wherein the voltage sensor includes:

a first sensor adapted to provide a first sense signal representative of a fraction of the voltage difference between the positive component signal and the neutral line;

a second sensor adapted to provide a second sense signal representative of a fraction of the voltage difference between the neutral line and the negative component signal;

a third sensor adapted to provide a third sense signal representative of a fraction of the voltage difference between the positive component signal and the negative component signal; and a full wave rectifier adapted to receive the first, second, and third sense signals, rectify and combine the first, second, and third sense signals, and provide the scaled input signal.

28. The voltage regulator as defined in claim 1, wherein the power source comprises a multi-phase, wye configured, alternating current power source having a first line, a second line, a third line, and a neutral line, the voltage regulator including a plurality of rectifiers connected to the power source and the voltage sensor and adapted to rectify positive voltage portions of the input signal present on the first, second, and third lines to provide a positive component signal and to rectify negative voltage portions of the input signal present on the first, second, and third lines to provide a negative component signal, wherein the voltage sensor generates the scaled input signal from the combination of the positive component signal and the negative component signal.

29. The voltage regulator as defined in claim 28, wherein the voltage sensor includes:

a first sensor adapted to provide a first sense signal representative of a fraction of the voltage difference between the positive component signal and the neutral line;

a second sensor adapted to provide a second sense signal representative of a fraction of the voltage difference between the neutral line and the negative component signal;

a third sensor adapted to provide a third sense signal representative of a fraction of the voltage difference between the positive component signal and the negative component signal; and a full wave rectifier adapted to receive the first, second, and third sense signals, rectify and combine the first, second, and third sense signals, and provide the scaled input signal.

30. The voltage regulator as defined in claim 1, wherein the power source comprises a multi-phase, delta configured, alternating current power source having a first line, a second line, and a third line, including a rectifier adapted to rectify and combine voltage portions of the input signal present on the first, second, and third lines to provide a rectified input signal to the voltage sensor, the voltage sensor providing a fractional portion of the rectified input signal as the scaled input signal.

31. The voltage regulator as defined in claim 1, including an inductor connected in series between the power source and the input terminals.

32. The voltage regulator as defined in claim 1, wherein the power source comprises a single phase alternating current power source, and the voltage regulator includes a rectifier connected to the power source and the voltage sensor and adapted to rectify the input signal and provide a rectified input signal to the voltage sensor, the voltage sensor providing a fractional portion of the rectified input signal as the scaled input signal.

33. The voltage regulator as defined in claim 1 wherein the control unit provides an activation signal when the scaled input signal exceeds the reference signal, and further comprising a display unit connected to the control unit adapted to count and display the number of activation signals.

34. The voltage regulator as defined in claim 1, further comprising an overflow device connected across the input terminals having an activation voltage adapted to dissipate a second portion of the input signal if the input signal exceeds the activation voltage.

35. The voltage regulator as defined in claim 34, wherein the overflow device includes at least one of a metal oxide varistor and a silicon avalanche diode.

36. A method for regulating an input voltage signal, the method comprising the acts of:

sensing the voltage of the input signal to determine an input voltage;

determining a reference voltage dependent on the input voltage that varies in response to changes in the input voltage;

comparing the input voltage and the reference voltage; and dissipating a portion of the energy in the input signal when the input voltage exceeds the reference voltage.

37. The method as defined in claim 36, wherein the act of determining a reference voltage comprises:

adding a first control voltage to the input voltage to derive a second control voltage;

increasing the reference voltage at a first rate corresponding to increases in the second control voltage; and decreasing the reference voltage at a second rate corresponding to decreases in the second control voltage.

38. The method as defined in claim 37, wherein the act of adding comprises adding a fraction of the input voltage to the input voltage to determine the first control voltage.

39. The method as defined in claim 37, including limiting the second control voltage to a predetermined voltage.

40. The method as defined in claim 36, further comprising the act of at least partially storing in a snubber a second portion of the input signal resulting from fast changes in the input signal with respect to time.

41. The method as defined in claim 36, further comprising the act of dissipating in an overflow device having an activation voltage a second portion of the input signal if the input signal exceeds the activation voltage.

42. The method as defined in claim 36, wherein the energy is dissipated in a variable load unit, the variable load unit comprises a plurality of power loads, and the act of dissipating comprises:

activating ones of the plurality of power loads as the magnitude of the difference between the input voltage and the reference voltage increases; and deactivating ones of the plurality of power loads as the magnitude of the difference between the input voltage and the reference voltage decreases.

43. The method as defined in claim 42, wherein the act of activating comprises activating the power load having been deactivated least recently.

44. The method as defined in claim 42, wherein the act of deactivating comprises deactivating the power load having been activated least recently.

45. The method as defined in claim 42, further comprising the act of storing ill a snubber an amount of energy remaining in an active power load after the power load has been deactivated.

46. A voltage regulator connected to a power source that supplies an input signal, comprising:

means for receiving the input signal and generating a scaled input signal from the input signal that is a fraction of the input signal in magnitude;

means for receiving the scaled input signal and generating a reference signal;

means for dissipating energy in the input signal; and means for receiving and comparing the scaled input signal and the reference signal and instructing the dissipating means to dissipate a first portion of the input signal if the scaled input signal exceeds the reference signal.

47. The voltage regulator as defined in claim 46, further comprising means for at least partially storing a second portion of the input signal resulting from high rate of change perturbations in the input signal.

48. The voltage regulator as defined in claim 41, further comprising means for dissipating a second portion of the input signal if the input signal exceeds a predetermined activation voltage.

* * * * *